US010639233B2

(12) United States Patent
Lue et al.

(10) Patent No.: US 10,639,233 B2
(45) Date of Patent: May 5, 2020

(54) OPTIMAL DOSAGES FOR LOW ENERGY SHOCK WAVE TREATMENT OF VITAL ORGANS

(71) Applicant: The Regents of the University of California, Oakland, CA (US)

(72) Inventors: Tom Lue, Hillsborough, CA (US); Ching-Shwun Lin, San Mateo, CA (US); Guiting Lin, San Francisco, CA (US); HongXiu Ning, San Francisco, CA (US)

(73) Assignee: The Regents of the University of California, Oakland, CA (US)

( * ) Notice: Subject to any disclaimer, the term of this patent is extended or adjusted under 35 U.S.C. 154(b) by 778 days.

(21) Appl. No.: 15/067,342

(22) Filed: Mar. 11, 2016

(65) Prior Publication Data

US 2017/0258676 A1 Sep. 14, 2017

(51) Int. Cl.
*A61H 23/00* (2006.01)

(52) U.S. Cl.
CPC ..... *A61H 23/008* (2013.01)

(58) Field of Classification Search
CPC ..... A61H 23/008; A61B 17/22004; A61B 2017/22025; A61B 17/225
See application file for complete search history.

(56) References Cited

U.S. PATENT DOCUMENTS 7,470,240 B2 12/2008 Schultheiss
7,544,171 B2 * 6/2009 Schaden ..... A61H 23/008 600/427
7,594,930 B2 * 9/2009 Warlick ..... A61B 17/0401 601/2
7,601,127 B2 10/2009 Schultheiss
7,988,648 B2 8/2011 Warlick
2006/0100550 A1 * 5/2006 Schultheiss ..... A61B 17/22004 601/2
2007/0239082 A1 * 10/2007 Schultheiss ..... A61B 17/22004 601/4
2011/0177576 A1 7/2011 Schaden
(Continued)

FOREIGN PATENT DOCUMENTS

WO WO2005075020 8/2005
WO WO2011006017 1/2011

OTHER PUBLICATIONS

Sonden et al., 2000, "Laser induced shock wave endothelial cell injury," Laser Surg. Med. 26:364-75.

(Continued)

*Primary Examiner* — David C Eastwood
*Assistant Examiner* — Milton Truong
(74) *Attorney, Agent, or Firm* — Mountain IP

(57) ABSTRACT

The treatment of various sensitive organs with low energy acoustic shockwaves has been proposed. However, the prior art is lacking in guidance as to what constitutes an efficacious minimum dosage or a safe maximum dosage for various target organs and tissues. Through extensive experimentation with cultured cells, live animals, and animal disease models, the inventors of the present disclosure have determined safe and efficacious shockwave energetic dosage ranges for vital and sensitive organs, including the brain, pancreas, kidneys, liver, and spleen, as well as for skin and subcutaneous tissues, peripheral nerves, and skeletal muscles.

14 Claims, 12 Drawing Sheets

(56) References Cited

U.S. PATENT DOCUMENTS

| | | | | |
|---|---|---|---|---|
| 2012/0239055 | A1 | 9/2012 | Spector | |
| 2013/0197404 | A1* | 8/2013 | Spector ..... | A61B 17/225 601/15 |
| 2014/0114326 | A1 | 4/2014 | Marlinghaus | |

OTHER PUBLICATIONS

Gambihler et al., 1990, Biological effects of shock waves, cell disruption, viability, and proliferation of L1210 cells exposed to shock waves in vitro, Ultrasound Med Biol., 16:587-94.

Genes et al., 1997, "Biological effects of interacting shock waves. A modeling study of the effects of interacting shock waves using erythrocyte hemolysis," Sb Lek (Prague Medical Report) 98:277-82 Abstract.

Zhang et al., 2014, "Dose effect relationship in extracorporeal shock wave therapy: the optimal parameter for extracorporeal shock wave therapy," J. Surg. Res. 186:484-292.

Calcagni et al,"Microvascular Response to Shock Wave Application in Striated Skin Muscle" J Surg Res. Nov. 2011;171(1):347-54. doi: 10.1016/j.jss.2009.12.011. Epub Jan. 5, 2010.

* cited by examiner

OPTIMAL DOSAGES FOR LOW ENERGY SHOCK WAVE TREATMENT OF VITAL ORGANS

STATEMENT REGARDING FEDERALLY SPONSORED RESEARCH OR DEVELOPMENT

This invention was made with government support under grant nos. R01 DK069655, R01 DK105097, and R37 DK045370 awarded by the National Institutes of Health, and grant no. W81XWH-13-2-0052 awarded by the United States Army Medical Research and Materiel Command. The government has certain rights in the invention.

CROSS-REFERENCE TO RELATED APPLICATIONS

Not applicable.

BACKGROUND OF THE INVENTION

Low energy shock wave (LESW) therapy is known in the art. Low energy shock waves are bursts of acoustic energy which may be applied extracorporeally. This therapeutic method has been used in orthopedic medicine to treat conditions such as tendinitis, non-union bone fracture, and chronic arthritic pain, by promoting analgesic and osteoinductive processes. Recently, LESW has been used to treat men with erectile dysfunction resulting from vascular insufficiency by promoting angiogenesis. Studies have also established that LESW improves blood circulation in the heart and in diabetic wounds and ulcers by promoting angiogenesis.

It has been suggested that LESW has utility beyond its established orthopedic indications and beyond its emerging use as a pro-angiogenic treatment. The prior art teaches that LESW may be applied in the treatment of various conditions including: diabetes, by the application of shock waves to the pancreas; diseases of the kidneys, by the application of shock waves to the kidneys; and neurological conditions, by the application of shock waves to the brain.

Despite the potential therapeutic benefits of applying LESW in these sensitive organs, it is also known that LESW can cause cellular and tissue damage. For example, in Koga et al, 1996, "Cumulative renal damage in dogs by repeated treatment with extracorporeal shock waves," Int. J. Urol. 3:134-140, it was demonstrated in dogs that application of LESW at energy densities "typically used for lithotripsy" (the specific energy densities are not provided) causes serious irreversible damage to kidneys by extensive hemorrhaging. Although lithotripsy waves are generally of higher energy than therapeutic shockwaves, this reference demonstrates the potential destructive power of LESW's. Experiments with cultured cells further demonstrate that LESW's can have damaging effects on cells, causing: hemolysis in red blood cells (Benes et al., 1997, "Biological effects of interacting shock waves. A modeling study of the effects of interacting shock waves using erythrocyte hemolysis," Sb Lek (Prague Medical Report) 98:277-82); reduced rates of cell proliferation in mouse lymphatic leukemia cells (Gambihler et al., 1990, Biological effects of shock waves, cell disruption, viability, and proliferation of L1210 cells exposed to shock waves in vitro," Ultrasound Med Biol., 16:587-94); and cell membrane damage in cultured epithelial cells (Sonden et al., 2000, "Laser induced shock wave endothelial cell injury," Laser Surg. Med. 26:364-75).

The detrimental effects of LESW observed at both the cellular and tissue levels dictate that excessive LESW energetic dosages must be avoided. Unfortunately, however, the teachings of the prior art provide little or no guidance as to what constitutes or how to determine a therapeutically effective LESW dosage that is below the threshold for cellular and/or tissue damage.

With respect to therapeutic treatment of the pancreas and kidneys with LESW, U.S. Pat. No. 7,988,648, by Warlick et al., entitled "Pancreas regeneration treatment for diabetics using extracorporeal acoustic shock waves," teaches the application of "a sufficient number" of unfocused shockwaves to the pancreas or kidneys having energy densities spanning five orders of magnitude, from 0.00001 to 1.0 mJ/mm$^2$. However, the "sufficient number" cannot be determined in the teachings of this reference. The reference states that energetic doses should be applied so as to avoid hemorrhaging, but does not teach what energetic dosage will result in hemorrhaging in the target organs.

PCT Application Publication Number WO/2011006017, by Cioanta et al., entitled "Usage of extracorporeal and intracorporeal shock waves in medicine," teaches the application of focused shock waves to the pancreas, kidneys, or brain, at total energetic deliveries between "less than 100 Joules" to "greater than 1,000 Joules," with no reference as to the area or volume in which this energy is applied, but which would constitute a very large amount of energy for the typical organ. The reference teaches that this energy can be delivered by administration of 500-50,000 shocks at energy flux densities of "less than 0.1 mJ/mm$^2$" to "greater than 0.3 mJ/mm$^2$, which, taken in combination would cover an enormous range of total energies. WO/2011006017 further teaches that LESW can cause hemorrhagic lesions and can destroy cells and tissues, but provides no teaching of what constitutes a therapeutic level of delivered energy that will avoid such undesirable damage.

With respect to treatment of the brain with LESW, U.S. Pat. No. 7,470,240, by Schultheiss et al., entitled "Pressure pulse/shock wave therapy methods and an apparatus for conducting the therapeutic methods," teaches the application of unfocused shock waves to the brain to combat neurological degenerative conditions such as Alzheimer's disease, the pulses having an energy flux density between 0.00001 to 1.0 mJ/mm$^2$ and being delivered for a time between "less than a second" and "as long as twenty minutes," with no teaching as to the frequency of pulse application that would allow the practitioner to determine the proper number of shocks to be delivered. Even assuming a typical pulse frequency of 3 Hz, this reference teaches the application of an enormous range of cumulative energies. The reference further teaches that dosages which cause hemorrhage must be avoided, but what constitutes such dosage is not provided.

United States Patent Application Publication Number 2014/0114326, by Marlinghaus and Heine, entitled "Device for shock wave treatment of the human brain," teaches the application of an unspecified number of focused shock waves to the brain at energy flux densities ranging 0.01 to 1.0 mJ/mm$^2$, cautioning that:

> "There must be a minimum dose to obtain a therapeutic effect, e.g. for thrombolysis, increased circulation, metabolism, removal of Amyloid beta or stimulation of nerves or brain cells. Exceeding a maximum dose must be prevented under any circumstances, as this may lead to dangerous side effects like hemorrhage."

However, the reference provides no teaching as to what conditions would establish such minimum and maximum dosages.

United States Patent Application Publication Number US20130197404, entitled "Method of improving kidney function by extracorporeal shockwaves," by Spector, teaches therapeutic treatment of the kidney with 100-5,000 shockwaves at energy densities of 0.02 to 0.18 mJ/mm$^2$. However, within this broad range of energetic dosing, there is no teaching as to which combination of energy densities and pulse count will fall within a safe and therapeutically efficacious window.

A reference which demonstrates the dose-dependent effects of LESW treatment is Zhang et al., 2014, "Dose effect relationship in extracorporeal shock wave therapy: the optimal parameter for extracorporeal shock wave therapy," J. Surg. Res. 186:484-292. In this study, LESW was applied to cultured epithelial cells at 5 energy flux density values ranging from 0.04 and to 0.16 mJ/mm$^2$, with 4 pulse numbers between 140 and 500 being applied. It was observed that LESW applied to cultured epithelial cells at energy flux densities between 0.1 and 0.16 mJ/mm$^2$ induced angiogenic factors and suppressed apoptotic factors, while lower energy flux densities had no angiogenic effect and higher energy flux densities caused cell death. The study is informative in that it demonstrates that an effective dosage range may exist, wherein a lower dosage does not induce desired effects and a higher dosage causes negative effects. However, the study is limited to a single cultured cell type (as opposed to intact organs) and the effect of pulse frequency is not explored (the pulse frequency used is not disclosed in the reference). While illuminating, the reference does not provide the art with guidance for determining effective LESW dosages for important target organs.

In summary, the prior art provides almost no guidance as to what constitutes a therapeutically effective and simultaneously non-harmful LESW dosage for the pancreas, brain, or kidney, as well as for other important tissues such as striated muscle or nerves. The prior art patents and patent applications described above disclose extremely broad ranges of LESW energy densities and give poor or no guidance as to the number of shocks that should be delivered. Further, the relationship between pulse frequency and biological effect is not known or explored in the prior references. Accordingly, there remains a need in the art to provide practitioners with a therapeutically bounded range of LESW dosages, wherein the energy received by the target organ is high enough to be therapeutically effective and low enough to avoid damage. To date, LESW has not yet been utilized for therapeutic treatment of the brain, kidney, or pancreas in any clinical trial or established therapy. It is likely that the failure to adopt LESW treatment in the treatment of these vital organs is at least in part due to the lack of an effective dosage regime.

SUMMARY OF THE INVENTION

Through extensive experimentation and creative insights, the inventors of the present disclosure have derived ranges of LESW dosages that are both efficacious and safe for the pancreas, kidney, brain, liver, spleen, skeletal muscle, and peripheral nerves. These dosages are supplied, in one aspect, as a novel measure of biologically effective cumulative energy delivered based upon the energy flux density of pulses delivered, the number of pulses delivered, and the frequency of pulse application. These disclosures provide the art with essential guidance for the practical application of LESW, allowing the practitioner to deliver safe and efficacious LESW treatments to various tissues and organs for the treatment of a large number of important conditions.

BRIEF DESCRIPTION OF THE FIGURES

FIGS. 1A, 1B, 1C, and 1D depict the dose dependent response of cell proliferation to various LESW dosages in cultured cells. FIG. 1A depicts the cell proliferation response of myoblast L6 cells to varying LESW dosages. FIG. 1B depicts the cell proliferation response of human umbilical vein endothelial cells (HUVEC) to varying LESW dosages. FIG. 1C depicts the cell proliferation response of rat Schwann cell RT4 cells to varying LESW dosages. FIG. 1D depicts the cell proliferation response of rat urethral smooth muscle cells to varying LESW dosages.

FIGS. 2A, 2B, 2C, 2D, 2E, 2F, 2G and 2H depict apoptotic frequency (percentage of total cells which are apoptotic cells) at varying LESW dosages in tissue sections taken from various organs of previously treated rats. FIG. 2A depicts apoptotic frequency in brain tissue. FIG. 2B depicts apoptotic frequency in kidney tissue. FIG. 2C depicts apoptotic frequency in pancreas tissues. FIG. 2D depicts apoptotic frequency in liver tissue. FIG. 2E depicts apoptotic frequency in spleen tissue. FIG. 2F depicts apoptotic frequency in skeletal muscle. FIG. 2G depicts apoptotic frequency in skin and subcutaneous tissue. FIG. 2H depicts the neurofilament damage index in peripheral nerves.

FIGS. 3A, 3B, 3C, 3D, 3E, 3F, and 3G depict hemorrhage frequency (abundance of hemorrhage spots per mm$^2$ tissue) at varying LESW dosages in tissue sections taken from various organs of previously treated rats. FIG. 3A depicts hemorrhage frequency in brain tissue. FIG. 3B depicts hemorrhage frequency in kidney tissue. FIG. 3C depicts hemorrhage frequency in pancreas tissues. FIG. 3D depicts hemorrhage frequency in liver tissue. FIG. 3E depicts hemorrhage frequency in spleen tissue. FIG. 3F depicts hemorrhage frequency in skeletal muscle. FIG. 3G depicts hemorrhage frequency in skin and subcutaneous tissue.

FIG. 4A summarizes the apoptotic frequency observed in various tissues at each tissue's selected safe dosage upper limit. FIG. 4B summarizes the hemorrhage frequency observed in various tissues at each tissue's selected safe dosage upper limit.

DETAILED DESCRIPTION OF THE INVENTION

Figure 1A:
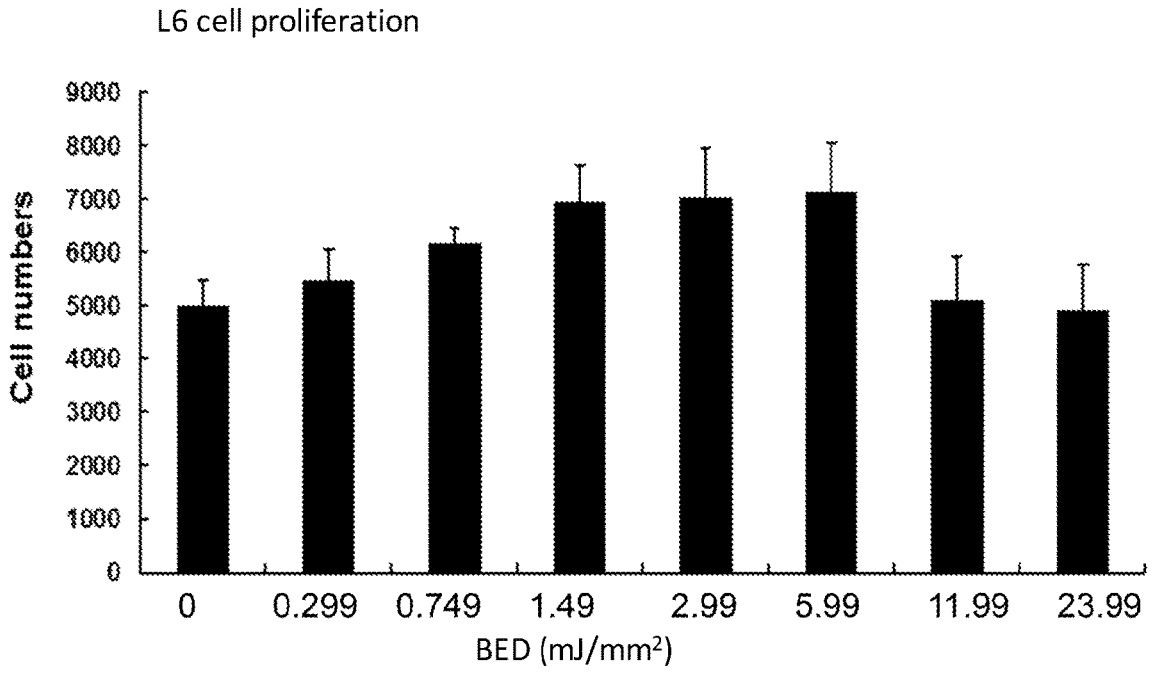
FIGS. 1A, 1B, 1C, and 1D.
Figure 1B:
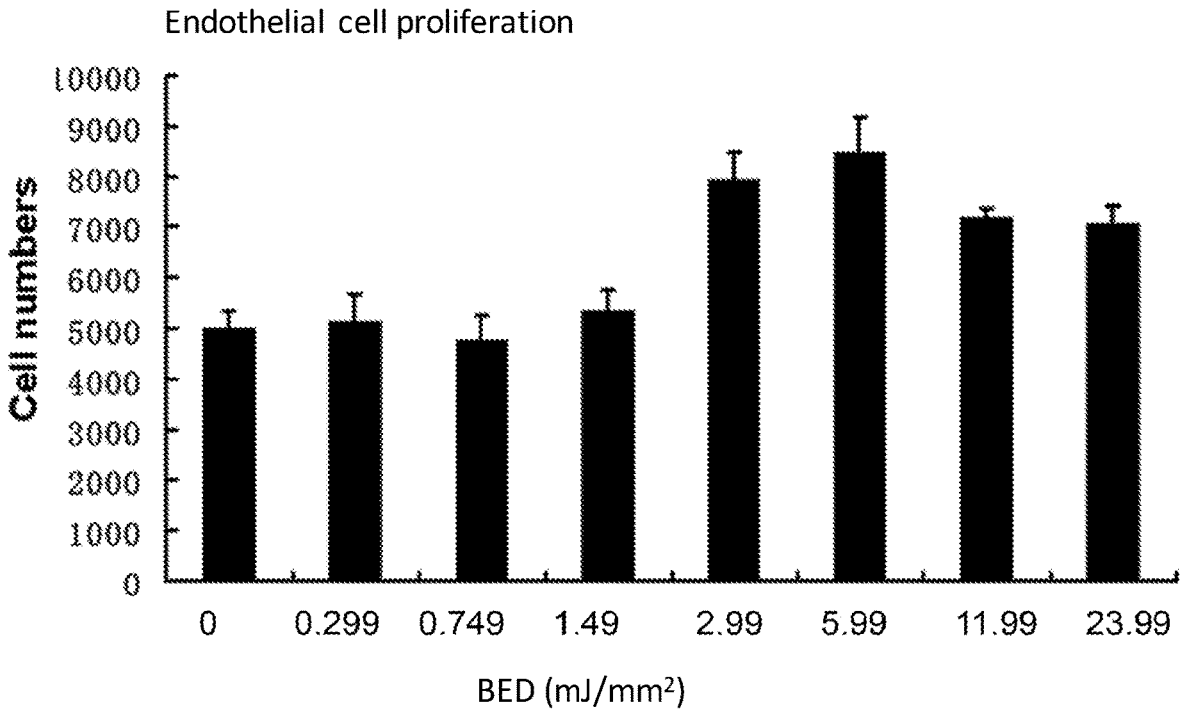
Figure 1C:
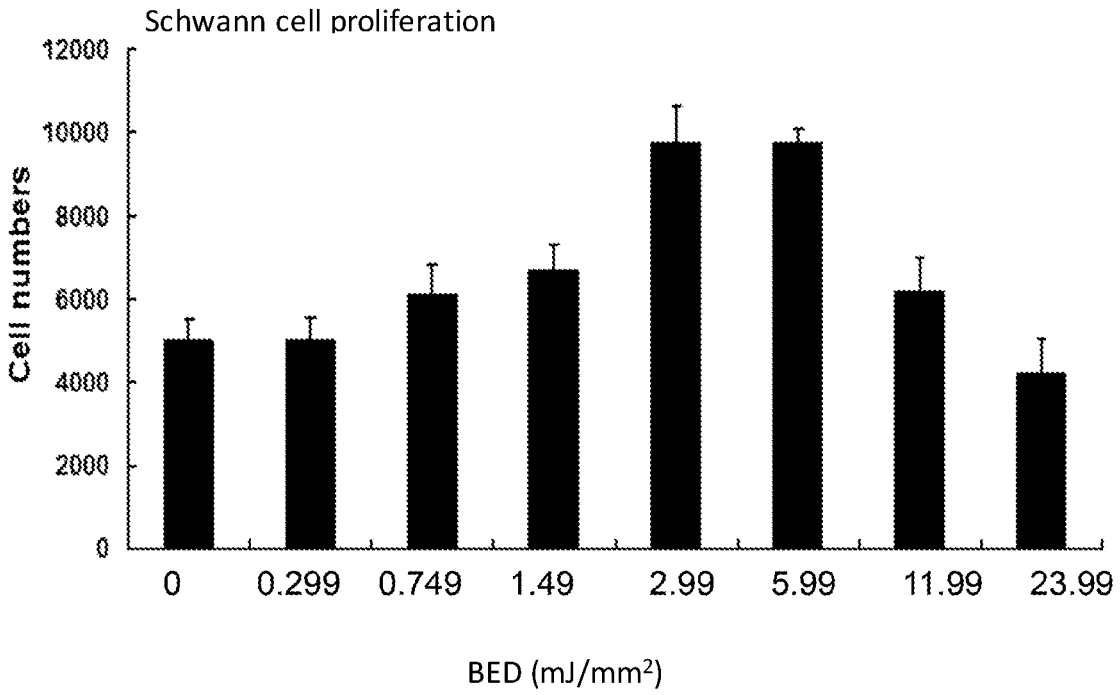
Figure 1D:
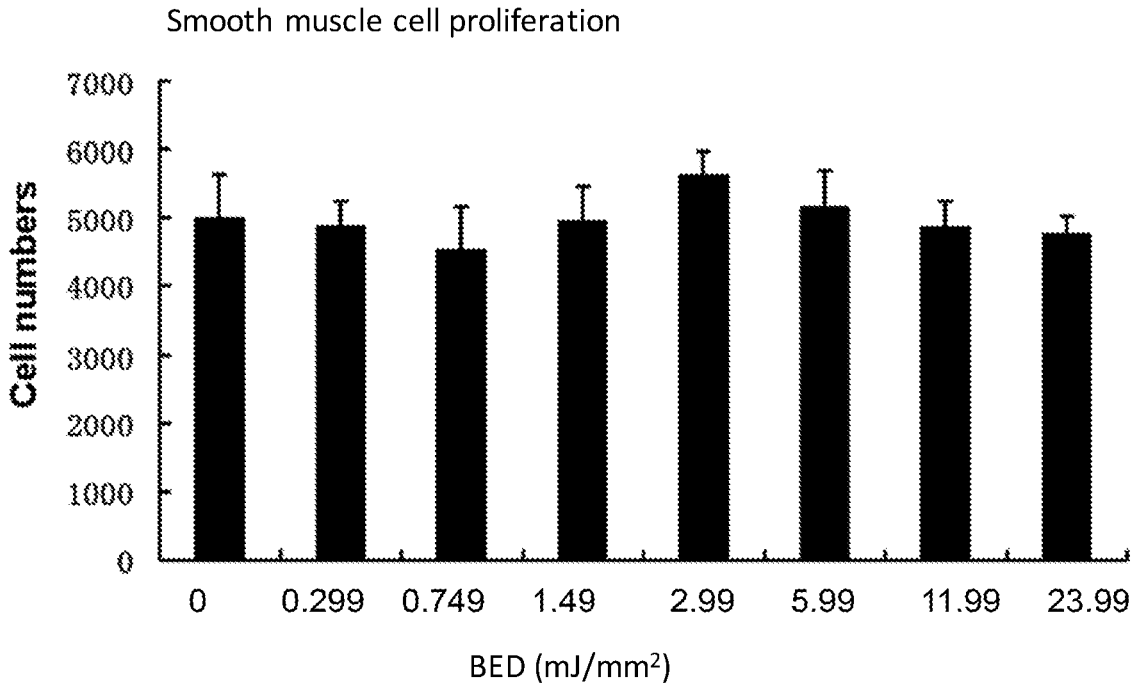
Figure 2A:
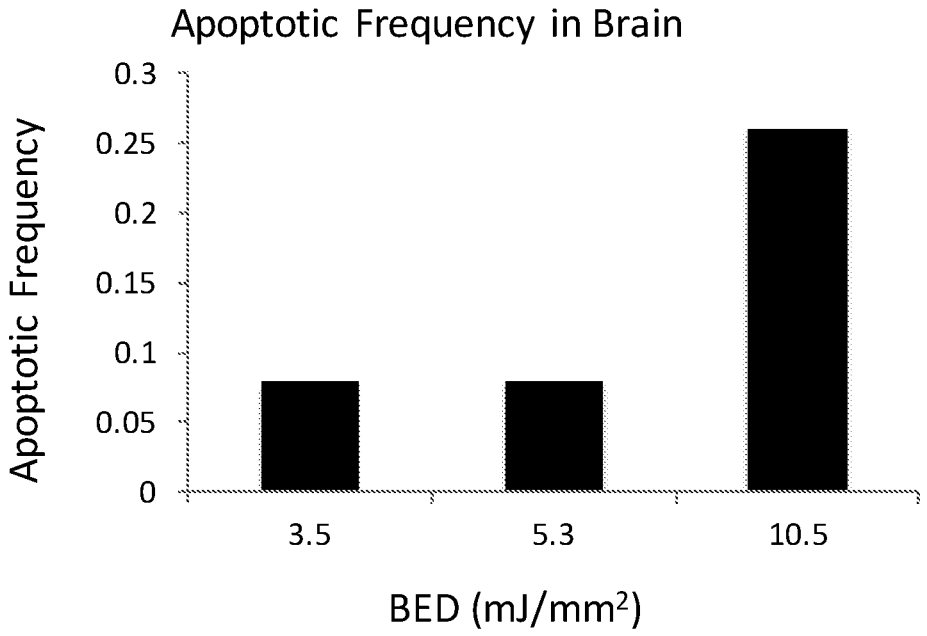
FIGS. 2A, 2B, 2C, 2D, 2E, 2F, 2G and 2H.
Figure 2B:
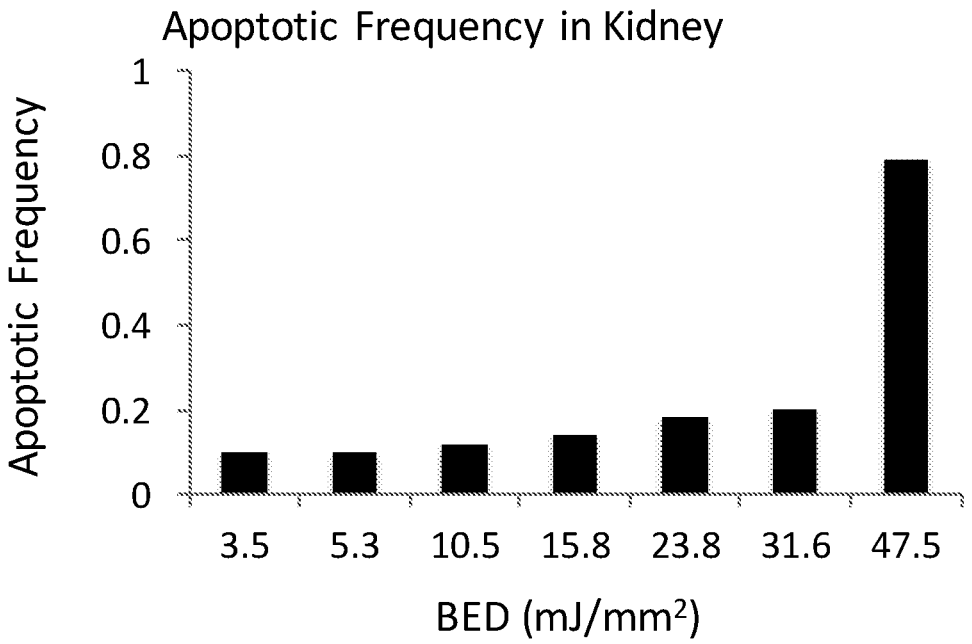
Figure 2C:
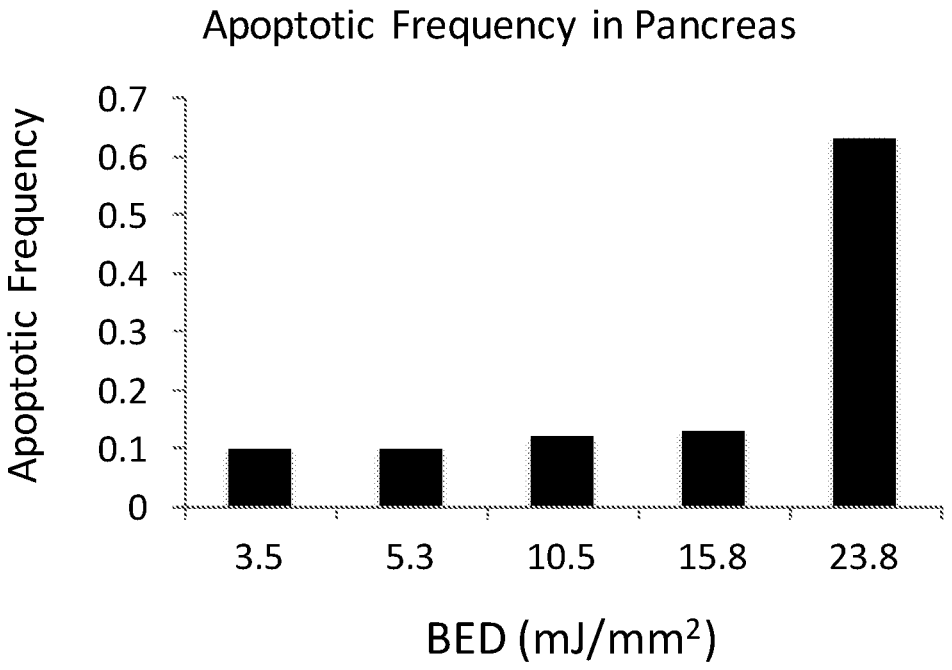
Figure 2D:
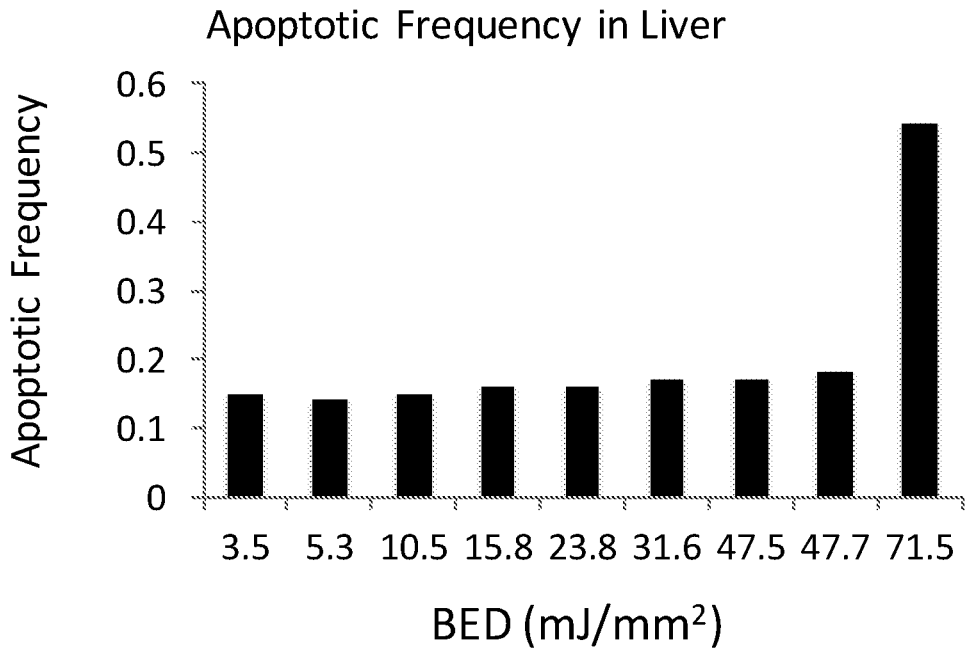
Figure 2E:
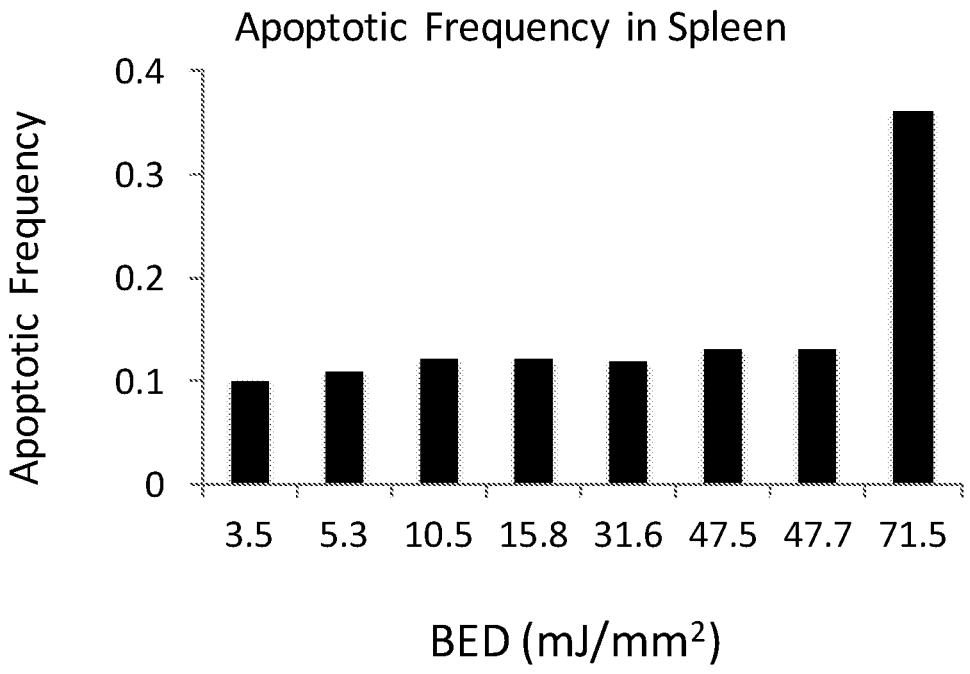
Figure 2F:
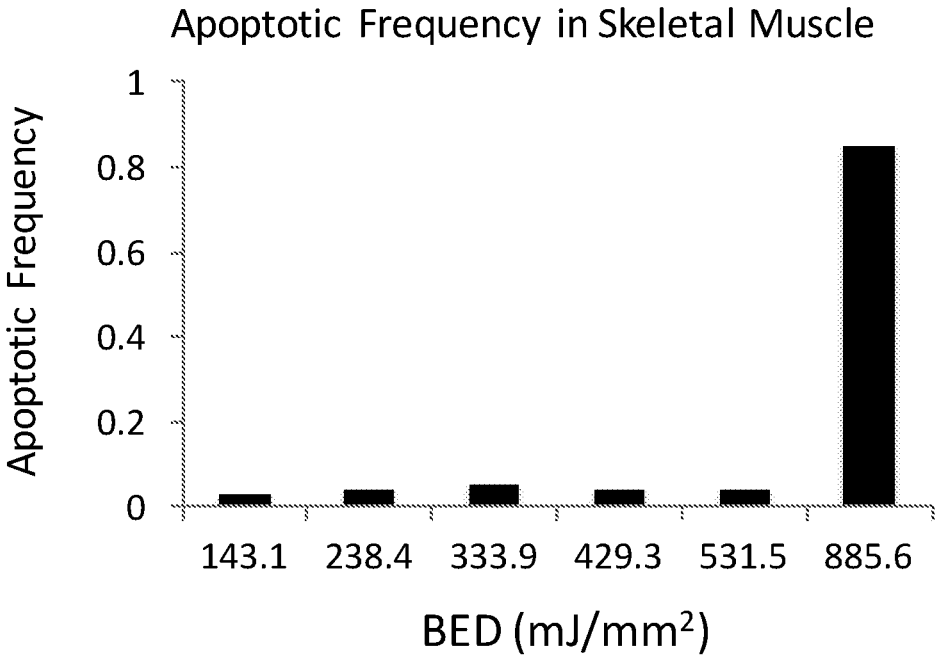
Figure 2G:
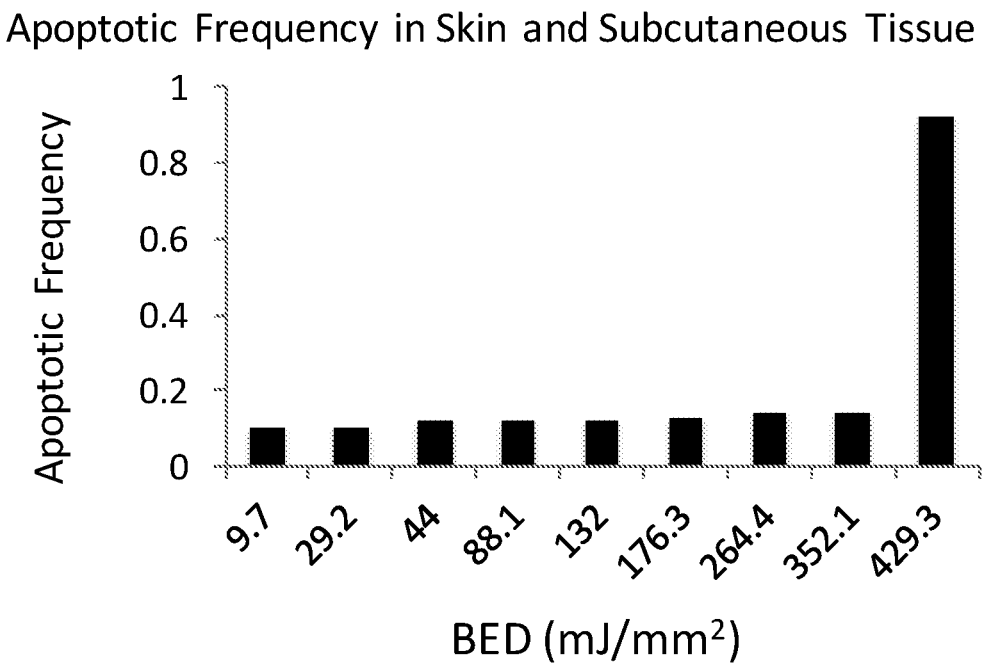
Figure 2H:
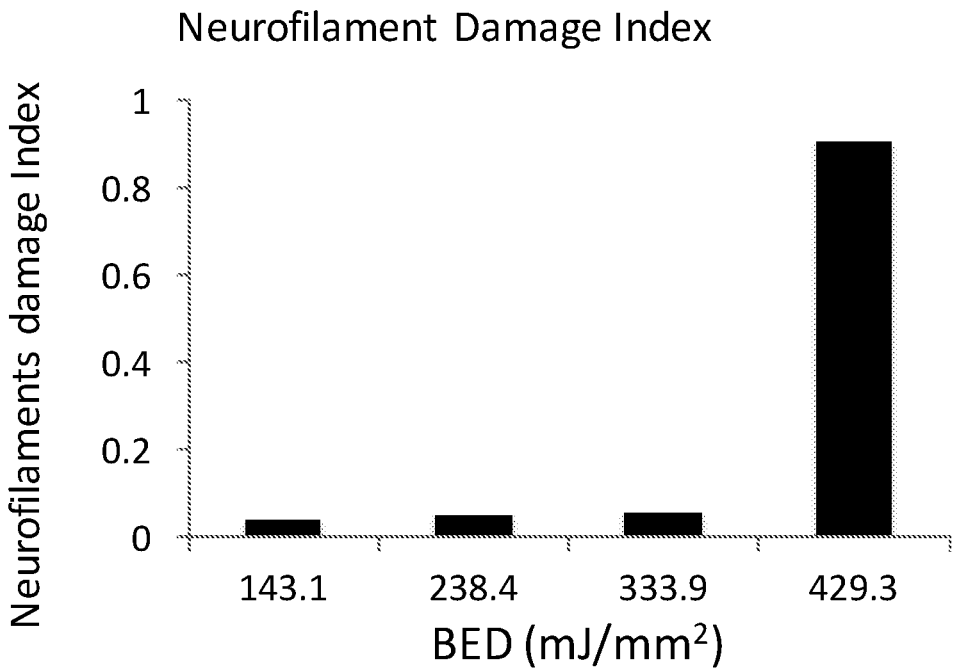
Figure 3A:
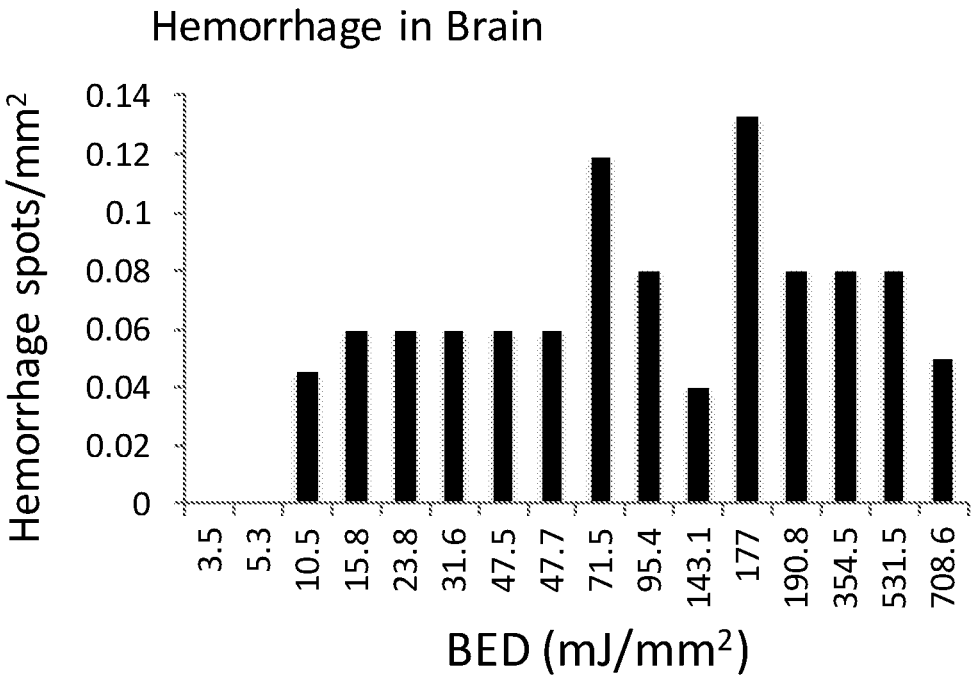
FIGS. 3A, 3B, 3C, 3D, 3E, 3F, and 3G.
Figure 3B:
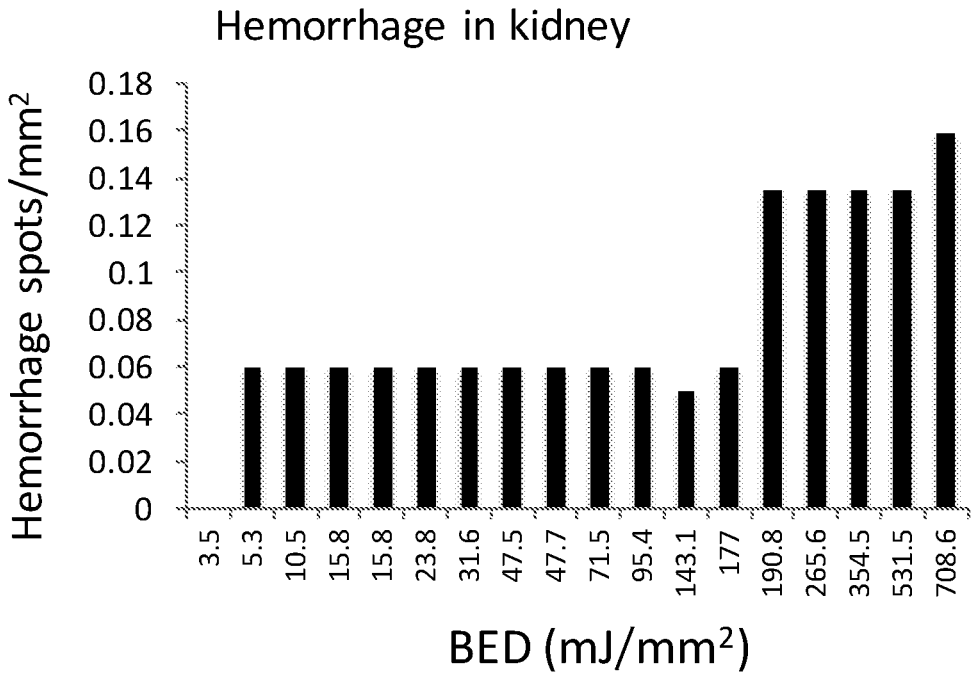
Figure 3C:
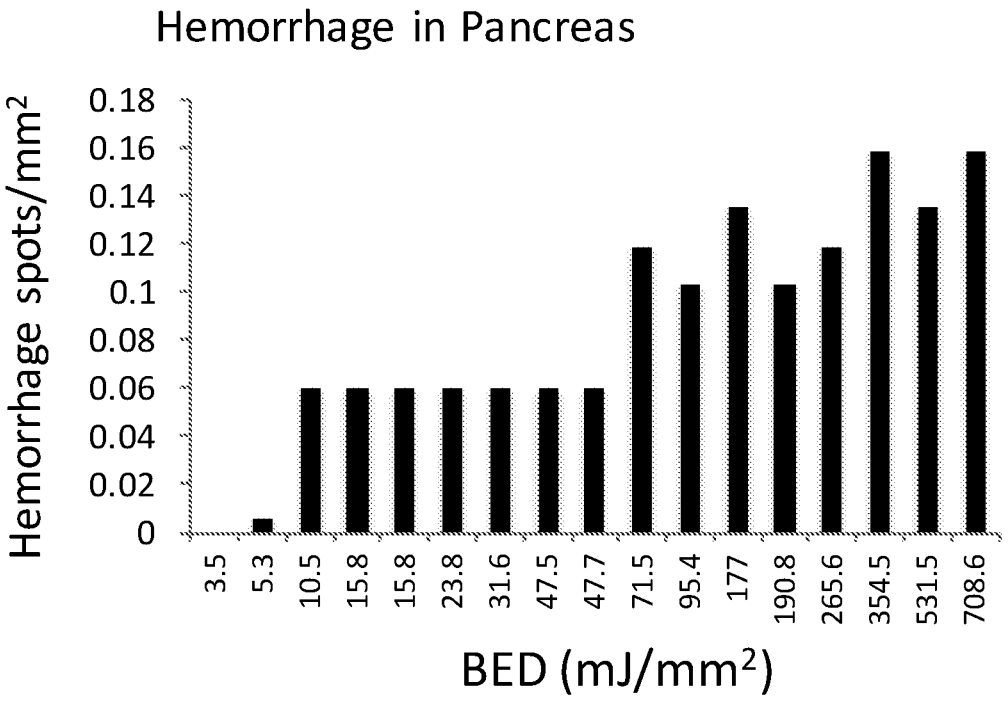
Figure 3D:
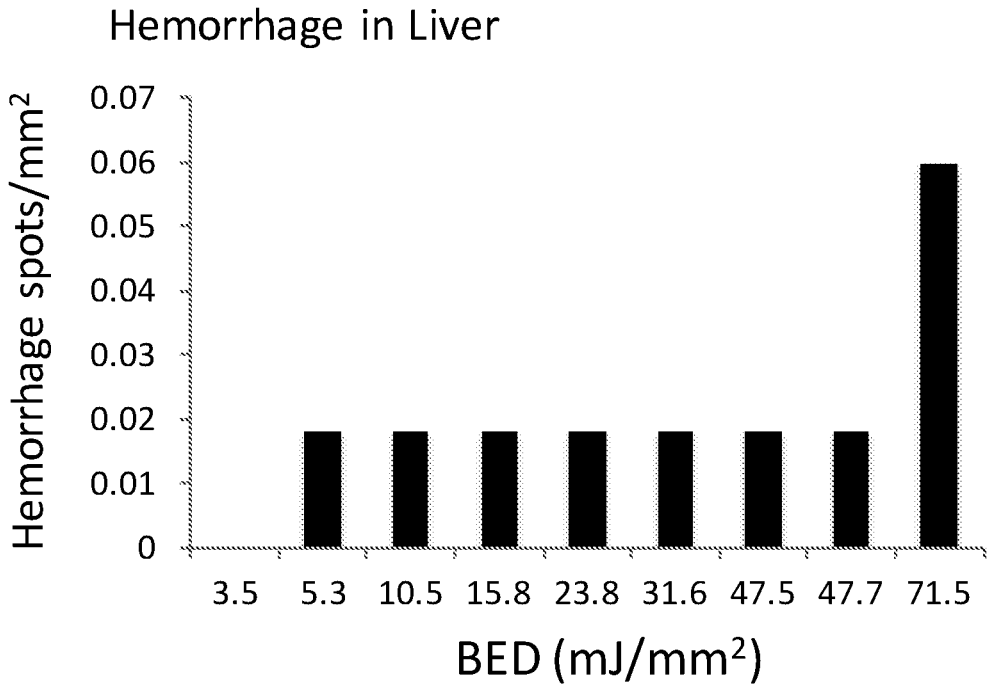
Figure 3E:
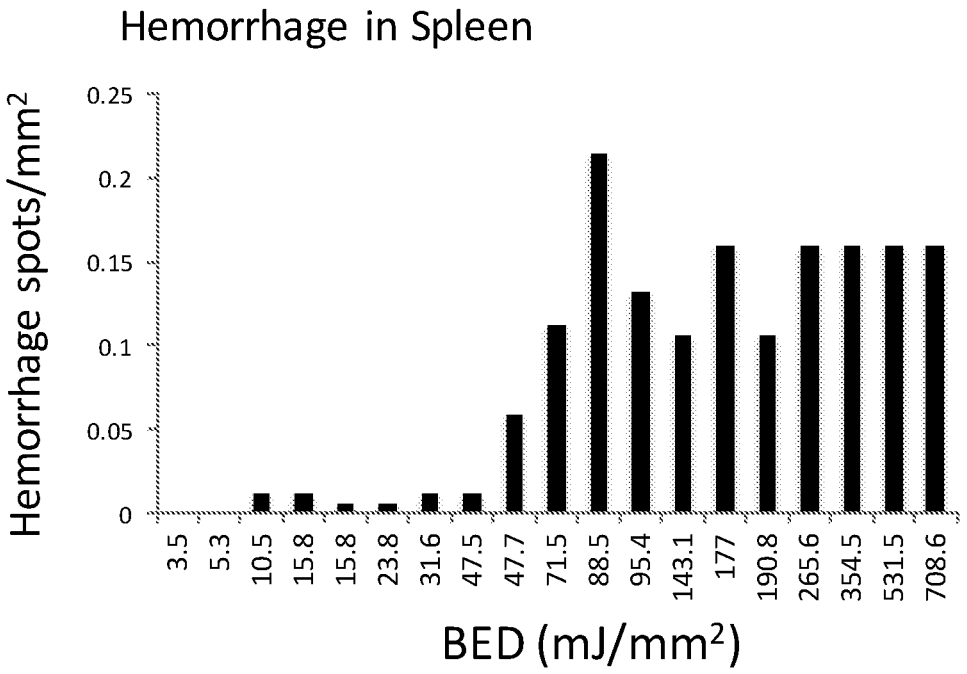
Figure 3F:
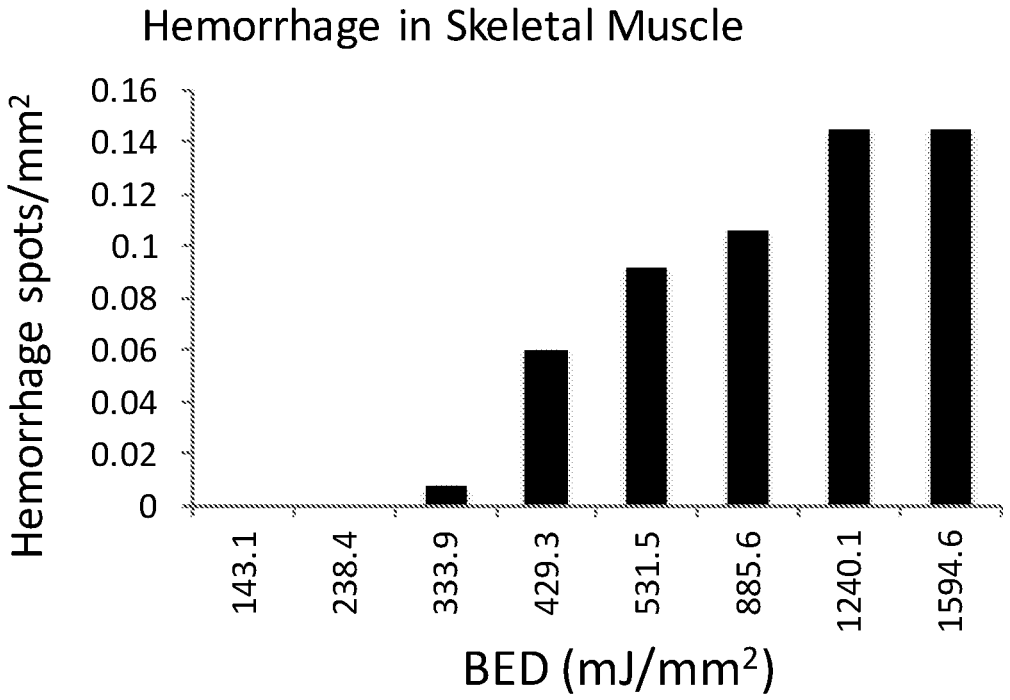
Figure 3G:
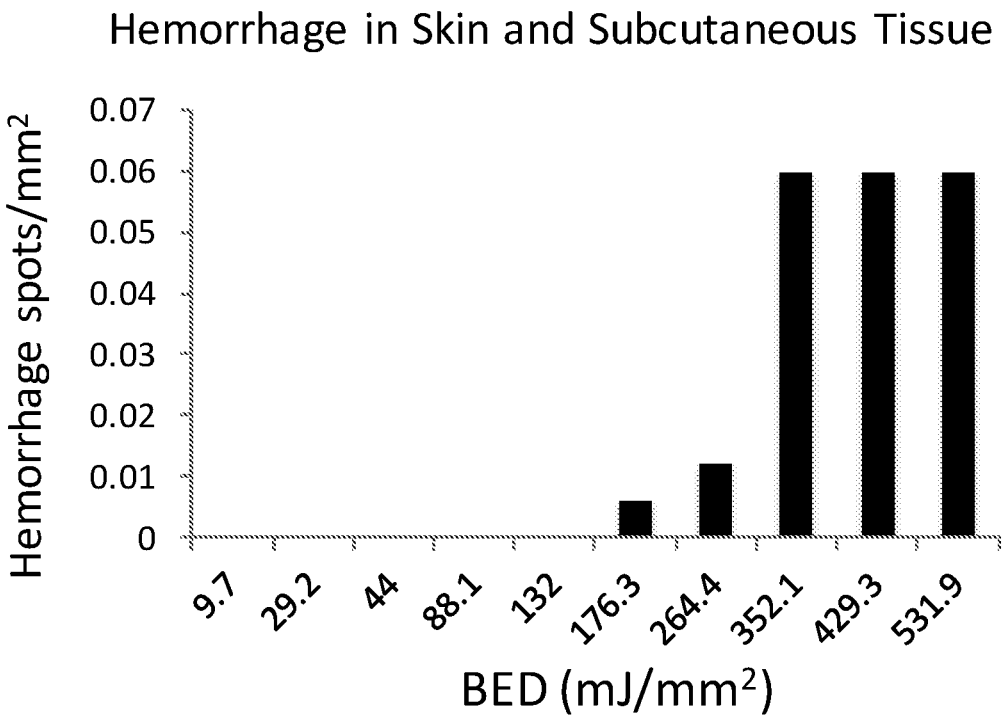

The invention is directed to the application of LESW dosages which are both efficacious and safe. In one aspect, the scope of the invention encompasses the administration of an LESW dosage to a target organ or tissue, wherein the dosage is sufficiently high to induce a beneficial or therapeutic effect in the target and is low enough to avoid causing harm or damage to the target. In another aspect, the scope of the invention comprises an improvement to the prior art methods of treating a target organ with LESW, wherein the improvement is limitation of the dosage to a range, wherein, within such range, the dosage is high enough to induce a beneficial or therapeutic effect in the target and is low enough to avoid causing harm or damage to the target.

A. Derivation of Dosages

LESW Dosage Components.

An LESW dosage, as used herein, refers to a measure of total LESW energy delivered, and the rate of energy delivery, in an LESW treatment session. An LESW treatment session comprises the delivery of a specific number of LESW pulses (i.e. individual shockwaves) to a target (e.g. a tissue, organ, or selected portion of an organ), wherein each pulse has an energetic component, and the pulses are delivered at a specific frequency. The energetic component is the shockwave's energy flux density (EFD), for example, expressed in millijoule (mJ) per $mm^2$. Typical commercially available LESW instruments can deliver shockwaves having energy flux densities in the range of 0.01 to 0.3 $mJ/mm^2$. Such instruments typically deliver the pulses at frequencies between 1 and 5 Hz. LESW treatments may comprise any number of shocks, however hundreds to low thousands of pulses (e.g. up to 5,000 pulses) are typically reported.

In order to provide the art with badly needed LESW dosage guidelines, it is an objective of the invention to delineate the biological effects of each component of an LESW dosage on a target cell or tissue, and therefrom, to derive dosage guidelines that allow a practitioner to deliver a therapeutically effective and non-harmful dosage to the selected cell or tissue type.

Physiological Basis of LESW-Induced Therapeutic Effects.

In order to derive efficacious and non-harmful LESW dosages for various tissues and organs, it was necessary to develop a methodology for assessing LESW's positive (i.e. therapeutic) and negative (i.e. damaging) effects.

Regarding cellular indicators that are correlated with LESW's therapeutic effects, the inventors of the present disclosure have advantageously identified the adaptive unfolded protein response (UPR) as a key universal mediator of LESW's therapeutic action. In addition, LESW stimulates mitochondria to produce adenosine triphosphate (ATP) which provides energy for energy-required biologic processes such as cell proliferation. Many of LESW's therapeutic effects in various tissue types appear to be caused by LESW-induced stress on the endoplasmic reticulum of a cell, which triggers the adaptive response. The downstream effects of the adaptive UPR include: recruiting of stem/progenitor cells from other parts of body such as bone marrow; activating stem/progenitor cells in situ at the site of treatment; and the de-differentiation of normal cells to immature cells that can proliferate to build new tissue, blood vessels and nerves. Accordingly, the therapeutic effects of LESW in a target tissue or organ can be tracked by monitoring indicators of adaptive UPR activation; and/or monitoring downstream processes activated by the UPR, including cell proliferation.

Another important measure of therapeutic effect is cell proliferation rate. This factor appears to be one of the most sensitive effectors of LESW's beneficial effects. In one embodiment, the therapeutic impact of LESW treatment can be assessed by measuring the effect of the treatment on cell proliferation rates, with elevated rates indicating an effective treatment. The effect of LESW on cell proliferation rates in stem/progenitor cells is an especially important indicator, as these cells underlie regenerative and healing processes in many pathological conditions. It will be understood that within a treated tissue, only a subset of cells is expected to proliferate, and that an "increase in proliferation" or an "increased proliferation rate" means that more cells within the treated tissue are proliferating and/or the proliferating cells are proliferating at a higher rate than in like untreated controls.

Physiological Basis of LESW-Induced Harm.

In developing LESW dosage guidelines, it was further necessary to monitor detrimental cellular or tissue responses to LESW, in order to determine what constitutes a harmful dosages which damages target cells or tissues. The inventors of the present disclosure observed two major sources of damage induced by LESW: apoptosis and hemorrhage.

Apoptosis is a normal process in the growth and maintenance of all tissues. It is estimated that the average human adult has more than 13 trillion cells, of which about 70 billion die per day. That is, about 5 out of every 1,000 cells (0.5%) die each day due to apoptosis. In high turnover tissue such as intestinal mucosa, the cell death rate is higher at about 0.8% per day. A treatment which unacceptably elevates apoptosis frequency over that observed in like untreated tissues is considered harmful.

LESW, at higher dosages, can overactive the UPR and tip the pathway from the adaptive response to the apoptotic response. When the apoptotic UPR response is activated, cellular repair and regeneration processes come to a halt, and multiple apoptotic pathways are activated, resulting in death of cells and necrosis in tissues.

Accordingly, UPR apoptotic markers, measured as the expression of proteins activated in the UPR apoptotic response, as well as apoptosis itself, assessed by known markers of apoptosis, can be used to assess what constitutes a damaging LESW dosage in selected cells or tissues, by determining LESW energetic dosages which cause excessive apoptosis substantially beyond that observed in healthy or untreated cells.

Another indicator of excessive LESW is hemorrhage, likely caused by physical damage to blood vessels from the energetic pulses applied. As with apoptosis, a baseline of level of micro-hemorrhage is normal and expected in many tissues, for example in being common in the skin or in striated muscles in people involved in contact sports, strenuous exercise, or taking blood thinning drugs. In fact, a small number of micro-hemorrhage spots with surrounding areas of cell death may trigger a regenerative response that is beneficial to the tissue/organ. However, a significantly elevated amount of hemorrhage above that observed in normal or untreated tissues is an indicator of harmful effects. Hemorrhage can be assessed by any means known in the art, for example by the visual observation of physical damage in treated tissues. Hemorrhage may be assessed by its prevalence in tissue, for example, the number of hemorrhage spots per $mm^2$ tissue section.

Biomarkers of therapeutic and harm indicators may be assessed by methodologies known in the art appropriate for the biomarker of interest, including visual observation (e.g. hemorrhage), direct or indirect quantification of gene expression (e.g. by quantitative PCR), protein abundance (e.g. by quantification using labeled antibodies), or levels of metabolites (e.g. by HPLC and or mass spectroscopy). In addition to the biomarkers enumerated herein, other biomarkers known to be associated with the UPR adaptive response, the UPR apotoptic response, apoptosis, and hemorrhage will fall within the scope of the invention, including biomarkers upstream or downstream of such effects.

LESW Dosage Parameters and a Novel Integrated Dosage Measure.

The discoveries disclosed herein were enabled by an extensive series of experiments, wherein the biological effects of a wide range of LESW dosages were monitored in a variety of cultured cell types, in vivo in various intact organs, and in various animal models of disease. The biological effects monitored included cell proliferation rates, adaptive UPR markers, apoptotic UPR markers, apoptosis, hemorrhage, and, in disease models, therapeutic outcomes. In some experiments, all three components that constitute an LESW dosage, including EFD, number of pulses, and the frequency of pulse delivery, were varied in a systematic fashion. This unprecedented survey of LESW dosage parameters on biological responses allowed the inventors of the present disclosure to derive the relationship between each component of the energetic dose and the resulting physiological effects of various dosages in different organs. These studies helped to elucidate the novel biological relationship between the various parameters of an LESW dosage and to define the bounds of a safe and LESW dosage in various organs.

In a first aspect, disclosed herein is the novel biological relationship between the various parameters of an LESW dosage. In short, the following was observed across a range of treated cell and tissues: the biological response to an LESW dosage is linear with respect to both the energy flux density of the delivered pulses and the number of pulses delivered, and, unexpectedly, is exponential with respect to the frequency of pulse application.

It was not previously known how biological systems would respond as each of the three LESW dosage variables were altered. The inventors of the present disclosure have advantageously, through extensive experimentation with cultured cells and live animals, determined the biological relationships between the three components of the LESW dosage with respect to several different types of cells, including the unexpected exponential effect of pulse frequency. Accordingly, the discoveries of the present disclosure allow, for the first time, the derivation of a novel and biologically relevant integrated dosage that accounts for the combined effects of all of these parameters. The integrated dosage, as used herein, refers to a measure of the physiologically relevant, cumulative LESW energy delivered in an LESW treatment session, taking into account energy flux density, number of pulses applied, and the frequency of pulse application. The dosage is integrated, in that it reconciles all three components of LESW energy delivery.

In one embodiment, the invention comprises the calculation of a Biologically Effective integrated Dosage ("BED"), wherein $$BED=EFD\times(N\times Hz^{k}) \qquad \text{Equation 1.}$$

wherein EFD means energy flux density per pulse, for example, measured in $mJ/mm^2$; N is the number of pulses delivered in the dosage; Hz is the frequency of pulse delivery, for example measured in pulses per second (Hz); and k is the coefficient of pulse frequency. In some embodiments, k=0.373. In some embodiments, k may vary between 0.25 and 0.5, for example between 0.30 and 0.44.

BED is a frequency-adjusted, biologically effective measure cumulative energy dosage. The term $(Hz)^k$ acts like a constant in the equation. The actual, physical energy delivered is EFD×N which yields total mJ delivered per $mm^2$. EFD×N is the same regardless of the time interval over which the energy is delivered. The inventors of the present disclosure have discovered that the biological effects of the total energy delivered vary depending on how fast the energy is delivered, wherein the faster a given amount of energy is delivered, the stronger its biological effect. As formulated in Equation 1, energetic dosage is upwardly adjusted by a "speed factor", being a fractional power function of the frequency: $(Hz)^k$. At 1 Hz, BED is EFD×N. When k is selected as 0.373, biologically effective energy delivered increases by about 30% at 2 Hz, by about 50% at 3 Hz and by about 80% at 5 Hz. The fact that Hz is raised to a fractional power means that the units in which Hz is measured, pulses/sec, are also raised to that power and thereby lose meaning. This term should therefore be treated as a unitless constant. For clarity, BED is a biologically effective frequency adjusted measure and is not a measure of cumulative energy as determined by physics. BED is an independent measure that has relevance only in the context of shockwave treatments. It will be understood that the energy-biological dosage parameter relationship described in Equation 1 may be described by alternative mathematical formulas.

The integrated biologically effective dosage calculations of the invention, including the BED, provide the art with a novel method of formulating a therapeutically relevant LESW dosage for particular types of tissue. Further, the methods of the invention allow, for the first time, a common dosage measure that accommodates definable ranges. Further, the methods of the invention allow, for the first time, a common dosage measure that accommodates any range of energy flux densities, pulse numbers, and pulse application frequencies. This advantageously allows, for the first time, a convenient side-by-side comparison of dosages which vary in the three dosage parameters. This also allows the practitioner, for the first time, to vary the three parameters of an LESW treatment session to achieve a desired dosage. For example, LESW applicator instruments typically are constrained by various settings, e.g. they can deliver LESW's at a limited number of discreet energy flux densities and can be set to a limited number of pulse delivery rates. Using the dosage calculation methods of the present invention, the proper number of pulses to deliver at an LESW instrument's particular EFD and frequency settings can be determined.

B. Safe and Efficacious LESW Dosages for Various Tissues and Organs

Treatment.

For convenience, the description provided herein will refer to the application of LESW's for the treatment of disease conditions. "Treatment," as used herein will refer to any form of treatment. For example, therapeutic treatment to reduce or eliminate a disease condition would constitute treatment, as would pre-treatment to prime or prepare a patient for an impending stress (e.g. application of chemotherapy). Treatment also encompasses preventative treatments which slow or prevent pathological processes or which increase resistance to or reduce susceptibility to a pathological process. As used herein, a "disease condition" refers to any pathological condition, disorder, injury, or other undesirable state, including, for example degenerative conditions, genetic disorders, autoimmune disorders, metabolic disorders, infections, exposure to toxic agents, trauma, and discomfort.

Defining Efficacious and Safe Dosages.

The scope of the invention encompasses the treatment of various targets with an efficacious and safe LESW dosage. A "target" as used herein, means a specific cell type, tissue type, or organ, or a region within a tissue or organ (e.g. a lobe of the brain or kidney, etc). An "efficacious and safe LESW dosage," as used herein, means a dosage applied in a treatment session, wherein the dosage comprises a specific number of pulses, the pulses having an EFD value, and wherein the pulses are delivered at a specific frequency. The efficacious and safe LESW dosage constitutes a dosage which is both efficacious, i.e. therapeutically effective, and safe, i.e. does not cause significant negative effects or damage.

The LESW dosages of the invention may be defined by a range having a lower limit and an upper limit. The lower limit represents the energetic dosage below which therapeutic effects are not induced in the target, i.e. below which the LESW is not therapeutically efficacious. The upper limit represents the energetic dosage above which harm is induced in the target, i.e. above which the LESW is not safely applied.

The lower limit of the efficacious and safe dosage is the efficacious threshold, being a dosage of sufficient energy to induce a desired therapeutic effect or transformation in the cells, tissue, or organ receiving it. In some embodiments, the therapeutic effect is an upregulation of the adaptive UPR. In some embodiments, the desired therapeutic effect is an increase in cell proliferation rates. In some embodiments, the desired therapeutic effect is the elevation, increase or maintenance of (relative to like untreated cells, tissues, or organs) the expression, presence, or activity of one or more markers of the adaptive UPR response. The one or more markers of the adaptive UPR response may be selected from the group consisting of: binding immunoglobulin protein (BiP), also known as glucose regulated protein 78 (GRP78); elevated spliced X-box binding protein 1 (XBP1); spliced XBP1 (sXBP1), to the extent that the ratio of sXBP1 to total XBP1 (spliced+unspliced) is below a ratio indicating apoptotic activity, for example a ratio in excess of 35%; activating transcription factor 4 (ATF4); Stromal derived factor 1 (SDF1); and Parkin.

In another embodiment, the desired therapeutic effect or transformation of the target caused by the therapeutically effective dosage is a decrease in the severity, progression, rate of progression, symptoms, underlying processes, or markers of a disease condition. The disease condition may comprise any pathology, including degenerative conditions, autoimmune conditions, conditions caused by infection, conditions caused by trauma, or conditions caused by chemical stress. A desired therapeutic effect or transformation may include, for example, halting or slowing of degenerative processes, activating and/or recruiting stem/progenitor cells in or to the target, and promoting regenerative processes in the target. In another aspect, the desired biological effect or transformation is causing the target to become more resistant to a disease state, as in preventative treatments.

The upper limit of the efficacious and safe dosage represents the safety threshold, being the dosage at or below which the treated cell, tissue, or organ does not experience clinically significant or unacceptable harm, harm being damage, impairment of function, or other negative consequences as a result of LESW application. Harm may be assessed by various indicators. Harm indicators are considered "elevated" when they exceed the prevalence or degree of such indicator in like untreated tissues.

In one embodiment, induction or upregulation of the UPR apoptotic response is a harm indicator. Markers of the apoptotic UPR response include, for example, elevated CHOP, an elevated ratio of spliced to total XBP1 (e.g >35%) and high cleaved caspase to uncleaved caspase levels (>25%).

In another embodiment, the harm indicator is elevated apoptosis. One measure of apoptosis is the apoptotic frequency, being the percentage of total cells which are apoptotic cells.

In another embodiment, elevated hemorrhage incidence in the treated tissue is a harm indicator.

Other variables may serve as harm indicators. For example, necrosis may serve as a harm indicator. In some embodiments, the harm indicator is a reduction in normal function, or an increase in a marker of dysfunction, in the target tissue. For example, organ-specific markers of dysfunction may be utilized, such as reduced islet or beta cell counts in the pancreas, increased creatinine or proteinuria in the kidney, etc.

Safety Thresholds.

The safety threshold which defines the upper limit of the efficacious and safe LESW dosage range may be selected based on varying criteria. For example, in one implementation of the invention, the upper limit of the efficacious and safe dosage range is that at which any elevation of a selected harm indicator is induced. In an alternative implementation of the invention, some elevation of a selected harm indicator is acceptable, because the target tissue is capable of recovering from the LESW-induced damage without long-term negative effects. In such implementations, the upper limit of the safe LESW dosage is defined as that at or below which no harm or acceptable levels of harm are induced.

The inventors of the present disclosure have advantageously developed a novel threshold measure for harm based on extensive observation of cells and organs treated with high LESW dosages. The novel threshold comprises a combined measure, wherein upper limits in both apoptotic frequency and hemorrhage frequency are jointly used to define unacceptable harm. As used herein, apoptotic frequency is the percentage of apoptotic cells in the treated tissue or organ and hemorrhage frequency is the number of hemorrhage spots visible per $mm^2$ of tissue. If a treatment exceeds either of the upper apoptotic frequency limit or upper hemorrhage frequency limit selected for a given organ/tissue, the treatment is deemed harmful.

The upper limits are selected on an organ or tissue-specific basis. For pancreas, kidney, liver, skin, nerves, and subcutaneous tissue, upper thresholds were selected based on the average frequency of apoptosis in the human body of 0.5% and the rationale that sparse and minute areas of hemorrhage may be beneficial. For these tissues/organs, the upper threshold for frequency of hemorrhage was set at a frequency of 0.06 or less hemorrhage spots per $mm^2$ tissue and the upper threshold for apoptosis was set at a frequency of 1% or less apoptotic cells in the treated tissue. In other words, in these tissues, an LESW dosage that causes 0.06 or more hemorrhage spots per $mm^2$ tissue and/or which causes apoptosis at a frequency of greater than 1% is considered harmful. For other organs/tissues, such as the brain, spleen, and skeletal muscle, the upper limits for apoptotic and hemorrhage frequency were set at different values, due to the special properties of those targets, as set forth below.

Received Dosages.

It will be understood that the efficacious and safe dosages disclosed herein comprise received or effective dosages, in that the disclosed values refer to the LESW energy actually experienced or received by the target. In other words, a received dosage is the physiologically relevant measure of the total energy experienced by the target in an LESW treatment session, after taking into account any attenuation of the delivered dosage, as discussed below. The dosage ranges described herein are advantageously described with respect to received dosages, providing a common measure of physiologically relevant energy across different delivery devices, waveforms, sites of applications, and other treatment variables.

Dosage Parameters.

The dosages of the invention may be applied in varying combinations of EFD, pulse number, and pulse delivery frequencies. In one embodiment, the EFD of the LESW dosage is between 0.001 and 0.25 $mJ/mm^2$. In one embodiment, the pulse frequency of the LESW dosage can be between 1 and 10 Hz, for example 1, 2, 3, 5, 7, or 10 Hz. In one embodiment, the LESW dosage comprises the administration of 50-5,000 pulses, for example, 100-1,000 pulses.

In one embodiment, the suitable dosages of the invention are expressed as BED, as in Equation 1. In one embodiment, the suitable dosages of the invention are calculated by selecting a first and a second dosage parameter, and then using Equation 1 to solve for the third dosage parameter. For example, in one embodiment, the EFD and frequency of pulse delivery are selected, for example based on available settings of an LESW instrument, and then, using Equation 1, the number of pulses sufficient to deliver the desired BED value is calculated.

Minimum Efficacious Dosage.

It was observed that cell proliferation by progenitor cells was the most sensitive positive indicator of LESW effect and that this effect was stimulated at BED values of 0.2 mJ/mm$^2$ and above. Accordingly, as progenitor cells are found in all tissues and are essential for regenerative and healing processes, in one embodiment, the minimum efficacious dosage for all cell, organ, and tissue types is a BED of 0.2 mJ/mm$^2$. It was also observed, across multiple cell and tissue types, that UPR responses were activated at a BED of about 1.5 mJ/mm$^2$. Accordingly, in one embodiment, the minimum efficacious dosage for all cell, organ, and tissue types is a BED of 1.5 mJ/mm$^2$.

Efficacious and Safe LESW Dosages for the Brain.

In one aspect, the invention encompasses the administration of an efficacious and safe LESW dosage to one or more regions of the brain. Such administration may be performed for any therapeutic or preventative treatment, for example, to treat or prevent disease conditions such as cerebral vascular accident, amyotrophic lateral sclerosis (ALS), ischemic damage, Alzheimer's, Parkinson's disease, brain trauma, dementia, and other neurological or brain-related conditions or diseases.

The brain is a vital and delicate organ, and it is known that many brain cells cannot regenerate. Accordingly, relatively low upper thresholds for the frequency of apoptosis and frequency of hemorrhage were selected for the brain. The upper threshold for apoptotic frequency was selected as 0.26% and the upper threshold for hemorrhage frequency was selected as 0.035 hemorrhage spots per mm$^2$ tissue. Based on these thresholds, in one embodiment, a safe LESW dosage for the brain is defined as one that induces an apoptotic frequency of 0.26% or less and a hemorrhage frequency of 0.035 hemorrhage spots per mm$^2$ tissue or less. At these thresholds, and using cell proliferation as a measure of the therapeutically effective minimum dosage, a safe and efficacious LESW dosage range for the tissues of the brain comprises a minimum therapeutically effective dosage having a BED value of 0.2 mJ/mm$^2$ and a maximum safe dosage having a BED value of 11 mJ/mm$^2$.

Efficacious and Safe LESW Dosages for the Kidney.

In one aspect, the invention encompasses the administration of a safe and efficacious LESW dosage to one or more regions of the kidney. Such administration may be performed for any therapeutic or preventative treatment, for example, to treat or prevent disease conditions such as acute renal failure, chronic kidney diseases, renal insufficiency, proteinuria, diabetic and lupus nephropathy, glomerulus calcification, tubulo-interstitial lesions, renal artery stenosis/ischemia, and other kidney-related conditions or diseases.

As set forth above, upper safety thresholds for the kidney were selected as a hemorrhage frequency of 0.06 or less hemorrhage spots per mm$^2$ tissue and the upper threshold for apoptosis was set at a frequency of 1% or less apoptotic cells in the treated tissue. At these thresholds, and using cell proliferation as a measure of the therapeutically effective minimum dosage, a safe and efficacious LESW dosage range for the tissues of the kidney comprises a minimum therapeutically effective dosage having a BED value of 0.2 mJ/mm$^2$ and a maximum safe dosage having a BED value of 48 mJ/mm$^2$.

Efficacious and Safe LESW Dosages for the Pancreas.

In one aspect, the invention encompasses the administration of a suitable LESW dosage to the pancreas. Such administration may be performed for any therapeutic or preventative treatment, for example, to treat or prevent disease conditions such as diabetes, including prediabetes, Type I or Type II diabetes, and other disease conditions of the pancreas.

As set forth above, upper safety thresholds for the pancreas were selected as a hemorrhage frequency of 0.06 or less hemorrhage spots per mm$^2$ tissue and the upper threshold for apoptosis was set at a frequency of 1% or less apoptotic cells in the treated tissue. At these thresholds, and using cell proliferation as a measure of the therapeutically effective minimum dosage, a safe and efficacious LESW dosage range for the pancreas comprises a minimum therapeutically effective dosage having a BED value of 0.2 mJ/mm$^2$ and a maximum safe dosage having a BED value of 24 mJ/mm$^2$.

Efficacious and Safe LESW Dosages for the Liver.

In one aspect, the invention encompasses the administration of a suitable LESW dosage to the liver. Such administration may be performed for any therapeutic or preventative treatment, for example, to treat or prevent disease conditions such as liver failure, fatty liver, cirrhosis, fibrosis, hepatitis, and other disease conditions of the liver.

As set forth above, upper safety thresholds for the liver were selected as a hemorrhage frequency of 0.06 or less hemorrhage spots per mm$^2$ tissue and the upper threshold for apoptosis was set at a frequency of 1% or less apoptotic cells in the treated tissue. At these thresholds, and using cell proliferation as a measure of the therapeutically effective minimum dosage, a safe and efficacious LESW dosage range for the tissues of the liver comprises a minimum therapeutically effective dosage having a BED value of 0.2 mJ/mm$^2$ and a maximum safe dosage having a BED value of 71 mJ/mm$^2$.

Efficacious and Safe LESW Dosages for the Spleen.

In one aspect, the invention encompasses the administration of a suitable LESW dosage to the spleen. Such administration may be performed for any therapeutic or preventative treatment, for example, to treat or prevent disease conditions such as enlarged spleen, functional asplenia, autoimmune diseases, and other disease conditions of the spleen.

For the spleen, the selected upper limits were a hemorrhage frequency of 0.12 or less hemorrhage spots per mm$^2$ tissue and the upper threshold for apoptosis was set at a frequency of 1% or less apoptotic cells in the treated tissue. The rationale for the higher hemorrhage limit in spleen is that the spleen produces and stores many cells involved in the immune response and autoimmune diseases and higher incidence of hemorrhage and apoptosis may be beneficial in the spleen for the elimination of undesirable cell types, as in autoimmune conditions or other imbalances of the spleen. At these selected thresholds, and using cell proliferation as a measure of the therapeutically effective minimum dosage, a safe and efficacious LESW dosage range for the tissues of the spleen comprises a minimum therapeutically effective dosage having a BED value of 0.2 mJ/mm$^2$ and a maximum safe dosage having a BED value of 71 mJ/mm$^2$.

Efficacious and Safe LESW Dosages for the Peripheral Nerves.

In one aspect, the invention encompasses the administration of a suitable LESW dosage to peripheral nerves. Such administration may be performed for any therapeutic or preventative treatment, for example, to treat or prevent disease conditions such as peripheral neuropathy, nerve injury or damage neuritis, ALS, diabetic neuropathy, nerve degeneration, demyelinating diseases (e.g. multiple sclerosis) and other neurological disease conditions. The treatment may also be applied to promote innervating or healing processes such as nerve muscle end plate formation.

Unlike other tissues, the measurement of apoptosis and hemorrhage frequency in peripheral nerves was not readily measured. For the peripheral nerves, an alternative measure of harm was developed, the neurofilament damage index, which is the percentage of total neurofilaments in each sample that were, measured by visual observation, swollen or damaged. An upper neurofiliment damage threshold of 1% was selected as this appeared to mark the onset of significant negative LESW effects in treated peripheral nerves. At this threshold, and using cell proliferation as a measure of the therapeutically effective minimum dosage, a safe and efficacious LESW dosage range for the peripheral nerves comprises a minimum therapeutically effective dosage having a BED value of 0.2 mJ/mm$^2$ and a maximum safe dosage having a BED value of 429 mJ/mm$^2$.

Suitable LESW Dosages for Skeletal Muscle.

In one aspect, the invention encompasses the administration of a suitable LESW dosage to striated muscles such as skeletal muscle. Such administration may be performed for any therapeutic or preventative treatment, for example, to treat or prevent disease conditions such as muscle degeneration, muscle atrophy, muscle injury, muscle weakness, sarcopenia, and other disease conditions wherein skeletal muscle is implicated, as well as muscle-building therapy. Striated muscle in the urethra is implicated in urinary incontinence, for example in female urinary incontinence, and the scope of the invention includes the treatment of the urethra or a portion thereof with LESW to treat all forms of incontinence, including female urinary incontinence. Additionally, the scope of the invention encompasses the treatment of the skeletal/striated muscle present in the anal sphincter to treat stool incontinence. Furthermore, the scope of the invention encompasses the treatment of the skeletal muscles around the vagina and in the pelvic floor to treat conditions caused by the weakening of such skeletal muscle.

The upper safety thresholds for skeletal muscle were selected as a hemorrhage frequency of 0.12 or less hemorrhage spots per mm$^2$ tissue and the upper threshold for apoptosis was set at a frequency of 1% or less apoptotic cells in the treated tissue. The upper threshold for hemorrhage was greater than that selected for most other tissues due to the apparently high tolerance of large pressure swings during exercise in muscle tissue. At these thresholds, and using cell proliferation as a measure of the therapeutically effective minimum dosage, a safe and efficacious LESW dosage range for skeletal muscle comprises a minimum therapeutically effective dosage having a BED value of 0.2 mJ/mm$^2$ and a maximum safe dosage having a BED value of 886 mJ/mm$^2$.

Notably, skeletal muscles are highly resistant to LESW compared to the other tissues described above, with little to no apoptosis or hemorrhage observed until very high LESW doses are applied. Striated muscle contraction and relaxation can generate tremendous pressure variations on the capillaries and nerves within the muscle, therefore these neurovascular structures are clearly constituted so as to resist very high pressure swings without damage.

Suitable LESW Dosages for Skin and Subcutaneous Tissue.

LESW's are typically (but not exclusively) applied extracorporeally. In such extracorporeal treatments, skin and subcutaneous tissues will inevitably be subjected to LESW's. Accordingly, it is important to know the upper safety thresholds for skin and subcutaneous tissues in order to enable the practitioner to avoid LESW dosages that are harmful at the site of application and in the intervening tissues between the LESW emitter and the target. This is especially important, since higher dosages may be applied extracorporeally in order to achieve the desired received dosages at the target, due to the effects of attenuation, as discussed below. Additionally, in some embodiments, LESW may be applied therapeutically to the skin and subcutaneous tissues, for example to promote regeneration (e.g. anti-aging therapy), wound healing, and other therapeutic/cosmetic outcomes such as hair growth, elimination of wrinkles and reduction of scar tissue.

As set forth above, upper safety thresholds for skin and subcutaneous tissue were selected as a hemorrhage frequency of 0.06 or less hemorrhage spots per mm$^2$ tissue and the upper threshold for apoptosis was set at a frequency of 1% or less apoptotic cells in the treated tissue. At these thresholds, and using cell proliferation as a measure of the therapeutically effective minimum dosage, a safe and efficacious LESW dosage range for the skin and subcutaneous tissue comprises a minimum therapeutically effective dosage having a BED value of 0.2 mJ/mm$^2$ and a maximum safe dosage having a BED value of 429 mJ/mm$^2$. Fortunately, the maximum dosage is fairly high, compared to the other target organs, allowing high dosages to be applied at the site of application.

C. Application of Safe and Efficacious LESW Dosages

Administered Dosages.

The dosages described above are the received dosages, experienced by the target. In a common implementation of LESW therapy, LESW treatments are applied extracorporeally. Such treatment modality advantageously allows for a non-invasive treatment of the patient. Accordingly, the methods of the invention further encompass what will be termed an "administered dosage," the administered dosage being an LESW dosage wherein the EFD value refers to the energy flux density of the shock waves delivered to the patient extracorporeally by the LESW instrument. The administered dosage will differ from the received dosage according to two factors: (1) the type of waveform emitted and its focal point, if any; and (2) the attenuation of shockwave energy by intervening tissues between the application site and the target.

With respect to waveform, LESW's may be delivered in a variety of waveforms. From the standpoint of the suitable dosage ranges provided herein, the invention is not limited to any particular waveform utilized to deliver the energy. The suitable dosages of the invention may be delivered in the form of focused waves, unfocused waves, divergent waves, planar waves, or convergent waves. Accordingly, to deliver a desired administered LESW dosage to a target, the practitioner must account for the waveform emitted and the distance of the target from the emitter to ensure accurate dosing. For example, focused waves will have highly variable energetic values at different positions along the path of the generated wave, with a maximum at the focal point and a steep drop-off in energy away from the focal point. In one embodiment, the shockwaves of the invention are administered as target-centered wide focused waves, wherein the focus will be the entire treated organ or a selected region of the treated organ. Such waves provide ease of delivery and accuracy in dosing, because a more consistent energy delivery profile is administered across a relatively greater volume of tissue. One of skill in the art may calculate the expected received dosage based on the parameters of the LESW machine used, or may determine the received dosage profile experimentally, as described below.

With respect to attenuation, if the target organ is not at or near the external surface of the patient being treated, the LESW energy applied extracorporeally may be substantially attenuated by intervening structures. The degree of attenuation will be referred to as the "attenuation factor," and it represents the degree or amount of attenuation, by processes such as absorption and scattering, of the energy flux density of the delivered waves by intervening structures through which the waves must travel to reach the target organ.

The determination of attenuation factors can be derived by one of skill in the art utilizing the known dissipative properties and thicknesses of the various tissues and structures intervening between the LESW instrument and the target organ. Additionally, the wave form emitted by the LESW source must be taken into account, as the dissipative properties of different wave types will vary.

With respect to attenuation by intervening tissues, bone and bowel gas are known to substantially impede LESW while soft tissues are generally more transmissive. In one implementation, the distance of the target organ or tissue from the location where the shockwave applicator will touch the body is measured in order to determine the thickness of intervening structures, for example such measurement being performed using ultrasound imaging, CAT scan or MRI. Bone such as skull has been shown to attenuate up to 50% of acoustic energy. In the case that the path from the applicator to the target organ or tissue contains bone, the output level of the shockwave device should be set so that the EFD at the location of the target organ or tissue is 10% higher than the desired EFD at the target site for every millimeter of bone thickness that must be traversed (e.g. 65% higher for a 6.5 mm thick male skull). Attenuation coefficients may also be calculated using known or measured attenuation properties of intervening tissue.

In one implementation, the attenuation properties of water are utilized to mimic non-bone and non-gas intervening structures in the body.

Accordingly, when determining an administered dosage for a particular LESW treatment, the waveform and energy delivery profile as well as the dissipative properties of tissues and structures intervening between the extracorporeal application site and the target organ must be accounted for. These parameters can be determined experimentally by a calibration process. For example, the energy delivery profile of a particular instrument and/or instrument settings can be determined by calibrating in a tank of water. For example, the emitter of the LESW instrument can be sealed in place in an opening on the side of a tank. The tank is subsequently filled with water. A piezoelectric probe is then placed at various distances from the emitter and pulses of varying energy are emitted. The pressure experienced by the probe at the varying distances allows for calculation of an attenuation curve in a medium that approximates non-bone tissue without air spaces for the specific waveform or waveform settings of the instrument.

It will be understood that the safety of the intervening tissues must be accounted for as well in formulating an administered dosage, such that damaging energetic dosages are not administered at the site of application and into the intervening tissue. Advantageously, the upper damage thresholds for various tissues disclosed herein provide the art with guidance for the application of a safe dosage that will not damage intervening tissues. In one embodiment, the applied dosage is a dosage wherein no intervening tissues (including the skin, for extracorporeal application) are subjected to an energetic dosage in excess of a BED value of 429, which was determined to be a safe upper limit for skin, subcutaneous tissue, and peripheral nerves (when harm is defined as an apoptotic frequency of greater than 1%, a hemorrhage frequency of greater than 0.06 hemorrhage spots per $mm^2$ tissue section, and a neurofilament damage index of greater than 1%)), all of which are common tissue types that will typically be present between the LESW applicator and the target.

Intracorporeal LESW Probes.

In addition to the extracorporeal application of LESW's, intracorporeal application may be performed as well, by the introduction of LESW-emitting probes introduced into the body either surgically, or preferably, via orifices. Intracorporeal administration of LESW's can place the LESW emitting source closer to the target, avoiding or ameliorating the attenuation of delivered waves by intervening structures.

LESW Instruments.

Delivery of LESW dosages may be accomplished by an LESW instrument. The instrument may be any LESW source, for example medical devices known in the art which generate shock waves by electrohydraulic (also referred to as spark gap) mechanisms, electromagnetic mechanisms, and piezoelectric mechanisms. Various LESW devices are known in the art, including, for example the ORTHO-GOLD™ system (by Tissue Regeneration Technologies), the SWISS DELORCLAST™ system (by Electro Medical System), the ARIES™ system (by Dornier MedTech), the MASTERPULS™ MP100 (by Storz Medical), the MTS DERMAGOLD™ (by MTS, Germany), the RENOVA™ (by Direx, Israel), the LITE-MED™ system (by Lite-Med Industries, Taiwan), and the MEDISPEC 1000™ (by Medispec, Yehud, Israel).

Number of Treatment Sessions and Duration of Therapy.

In practice, various considerations can be taken into account when determining LESW dosage parameters such as shockwave energy and the number of pulses to be applied. For example, shockwaves having low energetic flux densities must be applied in larger numbers than shockwaves having higher energies, which extends treatment times. In general, shockwaves having an energetic flux density of 0.25 $mJ/mm^2$ or greater are painful to the patient, and cannot be applied in substantial numbers without the use of local or general anesthesia. Accordingly, the application of shockwaves having an energy flux density of less than 0.25 $mJ/mm^2$ is typically desirable.

The dosages of the invention may be applied in various treatment regimens which specify the timing and duration of treatments, each treatment, as used herein, comprising an individual dosage application. A treatment regimen may, for example, specify the number of treatments per week and the total number of treatments to be applied.

With respect to the number of treatments to be applied and the duration of the treatment regimen, this will depend on the condition being addressed. For example, in treatment to promote regeneration of injured or degenerated target organs, the patient should be treated for as long as necessary to effect the desired healing and/or restoration of the injured tissues. When the treatment is for preventative care, long term treatment regimens are appropriate to keep the target organ in a desired state of defense or activation.

In some embodiments, the LESW treatments are applied in a first and a second phase. In the first phase, energetic dosages are higher and/or applied more frequently in order to achieve a desired therapeutic outcome. In the second phase, LESW treatments are applied with lower energetic dosages and/or at less frequency in a maintenance regime to sustain the therapeutic gains As a rule, treatment on consecutive days should be avoided. The inventors of the present disclosure have discovered that LESW's UPR activation effects last for 24-72 hours before treated cells return to normal. UPR apoptotic responses are activated in response to the accumulation of UPR stress-induced species. Accordingly, LESW treatment on consecutive days may lead to negative cellular effects and the onset of apoptosis, and at least a 48 hour interval should be allowed between treatments in order to avoid over-accumulation of UPR stress-induced proteins or transcripts to avoid such deleterious effects. In general, for the dosages described herein, three treatments per week, with 1-2 days between treatments is desirable.

Preventative Treatment.

It will be understood that the suitable dosages described herein may be applied in a preventative context, wherein the desired biological effect is to potentiate or make target tissues/organs more resistant to stresses or disease conditions. Preventative treatments may be applied, for example, in advance of planned or potential chemical exposure (e.g. exposure to workplace toxins or chemotherapeutic or other drugs having undesirable side effects) or may be applied to subjects at risk for a disease state, for example subjects having a genetic disposition to a disease state, obesity, high blood pressure, elevated blood sugar, or other risk factors (e.g. aging).

Treatment Subjects.

It will be understood that the various embodiments of the invention may be directed to LESW treatment in any type of animal. While therapeutic dosing and treatment of human patients is the primary focus of this disclosure, it will be understood that dosages may be defined and administered to any animal species using the methods of the invention, including non-human animals treated for veterinary or research purposes. For example, the methods of the invention may be applied to cats, dogs, horses, cows, pigs, mice, rats, and non-human primates.

EXAMPLES

Example 1. Shockwave Generator Calibration

Two shockwave generators were calibrated. The first was an MTS DERMAGOLD™ system, by MTS Medical, Germany (hereafter, "the Dermagold instrument"). The second machine was an ESWT shockwave system, by Lite-Med (Taiwan) (hereafter, "the Lite-Med instrument"). The Lite-Med machine was modified by replacing the converging acoustic lens with a lens that emitted shockwaves nearly parallel to the central axis.

Both machines were calibrated to determine the spatial distribution of energy density emitted along the central axis of the emitter and orthogonal to this axis. These calibrations were used to determine how much shockwave energy was applied to each target tissue or cell based on the location of the target relative to the emitter.

The methodology for measuring the energy density at points various distances from the emitter was as follows:

A hole was cut in the side of a 7 gallon tank that exactly fit the diameter of the water cushion on the shockwave emitter. The emitter was secured to the hole with a watertight seal and the tank was filled with water.

A polyvinylidene fluoride (PVDF) piezoelectric probe (Müller-Platte Needle Probe #100-100-1) was positioned at various measurement coordinates in the water tank. Pulses were emitted from the shockwave device at varying device output settings. Multiple pulses were used for each probe location and output setting.

Each shockwave that encountered the probe caused the probe to emit a voltage corresponding to the instantaneous pressure of the shockwave as a function of time. This voltage curve was digitized and stored for subsequent analysis.

The energy density of each pulse at each coordinate was obtained by integrating the pressure function over time. The pressure function was derived from the measured voltage function using the probe manufacturer's specifications. The pulse intensity integral $P_{II}$(mJ/mm$^2$) was derived using equation C.3 from the International Electrotechnical Commission's Standard (IEC) 61846.

Example 2. Cell Culture Experiments

LESW treatments comprising varying dosages were administered to cultured cells. Energy flux density (EFD), number of pulses, and frequency were varied.

In order to determine the biological effects of varying LESW dosages, four cell lines were selected, representative of the cell types common to all organs and tissues. Myoblast L6 cells were selected as model cells representative of progenitor cells. Rat Schwann cell RT4 cells were chosen as representative Schwan cells which are essential in maintaining nerve integrity and function. Human endothelium HUVEC cells were selected as representative of endothelial cells which line the inner surface of a blood vessel. Rat urethral smooth muscle cell (RUSMC) cells were selected as model cells representative of smooth muscle cells which are present in all blood vessels except the capillaries.

The biological effects of LESW have been studied by many researchers and the following effects have been determined in various organs: growth factor secretion, cell proliferation, cell cycling, XBP1 splicing, heat shock proteins (e.g. BiP) production, angiogenesis, nerve regeneration, stem/progenitor cell activation, etc. Among these effects, cell proliferation is most sensitive and reproducible, and biologically significant, therefore, cell proliferation was used as the indicator to define the beneficial effect of LESW on cells.

Previous research by the inventors of the present disclosure indicated that over-induction of the UPR will push cells into the UPR apoptotic pathway. Therefore, apoptosis was selected as the parameter to assess harmful effects of LESW in cultured cells.

The cells were cultured in DMEM with 10% FBS (v/v), then harvested in log phase growth using trypsin:EDTA. Viable cell numbers were assessed with trypan blue viability stain and cells were re-suspended in 10% FBS DMEM medium. 5000 cells were seeded in 96-well plate. The cells were cultured for 24 hours before LESW treatment.

In the treatment step, various aliquots of cells were treated with LESW's with the Lite-Med instrument emitting semi-focused waves at systematically varied EFD settings (0.0088, 0.02, and 0.0241, and 0.0497 mJ/mm$^2$), for varying numbers of pulses (10, 25, 50, 100, 200, 400 and 800), at two different frequencies (1 and 3 Hz).

Forty-eight hours after LESW treatment, cell proliferation and apoptosis were assayed in the cultured cells.

Cell proliferation was assayed using the CELLTITER 96™ assay. No cell proliferation was observed in cell lines treated with the lower LESW dosages. Cell numbers increased, in a dose dependent manner in all four cell lines at intermediate dosages, with cell numbers/proliferation falling off at higher dosages. Similar results were observed across all four model cell lines. Representative results are summarized in FIG. 1.

Apoptosis was measured by Caspase-3 staining. Cells were cultured on glass cover slides and LESW was applied as above. Forty-eight hours later, cells were fixed with ice-cold methanol for 8 min, permeabilized with 0.05% Triton X-100 for 5 min, and blocked with 5% normal horse serum in PBS for 1 h at room temperature. The cells were then incubated with the primary antibody anti-Caspase 3 (1:500) for 1 hr at room temperature. After washing with PBS three times, the cells were incubated with the secondary antibody FITC-conjugated goat anti-rabbit IgG (1:500, Chemicon, Inc., Temecula, Calif.) for 1 hr at room temperature. Cells were further counter stained with 4',6-diamidino-2-phenylindole (DAPI, for nuclear staining) for 5 minutes and viewed under a fluorescence microscope. The apoptotic cells appeared in green color. The total number of cells and the number of apoptotic cells were quantified, and the ratio of apoptotic cells to total cells was then calculated.

At lower and intermediate energetic dosages apoptosis was not increased over that of untreated controls. At higher dosages, apoptosis was significantly increased over that in untreated controls. Representative results are summarized in FIG. 2.

Example 3. Animal Studies

Additional experiments were conducted on 120 rats in order to assess harmful effects of LESW at varying dosage parameters. Targeted organs were treated with LESW's with the Lite-Med instrument at varying EFD settings (0.07 and 0.26 mJ/mm$^2$), for varying numbers of pulses (50, 150, 226, 452, 905, 1357, and 1809), at two different frequencies (1 and 3 Hz). Due to the small size of the rats, relative to the size of the shockwave emitter, the administered dosage was assumed to be the received dosage.

Forty eight hours after treatment, rats were sacrificed and dissected to isolate tissue samples from the brain, liver, spleen, pancreas, kidney, skin and subcutaneous tissue, and skeletal muscle.

Hemorrhage was selected as a first indicator of harmful LESW dosage. The incidence and severity of micro-hemorrhage was assessed by hematoxylin and eosin staining in sections of target tissues. In brief, the tissue was fixed with 2% formaldehyde and 0.002% picric acid in 0.1 M phosphate-buffered saline (PBS) for 4 hours, followed by immersion in 30% sucrose in PBS overnight at 4° C. The fixed tissue was then embedded in optimal cutting temperature compound (Sakura Finetek, Torrance, Calif., USA), cut into 5-um-thick sections, mounted on glass slides. The sectional area was known and consistent across samples. Hemorrhage regions were clearly visible as stained spots within each tissue section. Micro-hemorrhage was scored blindly by two independent investigators.

Figure 4A:
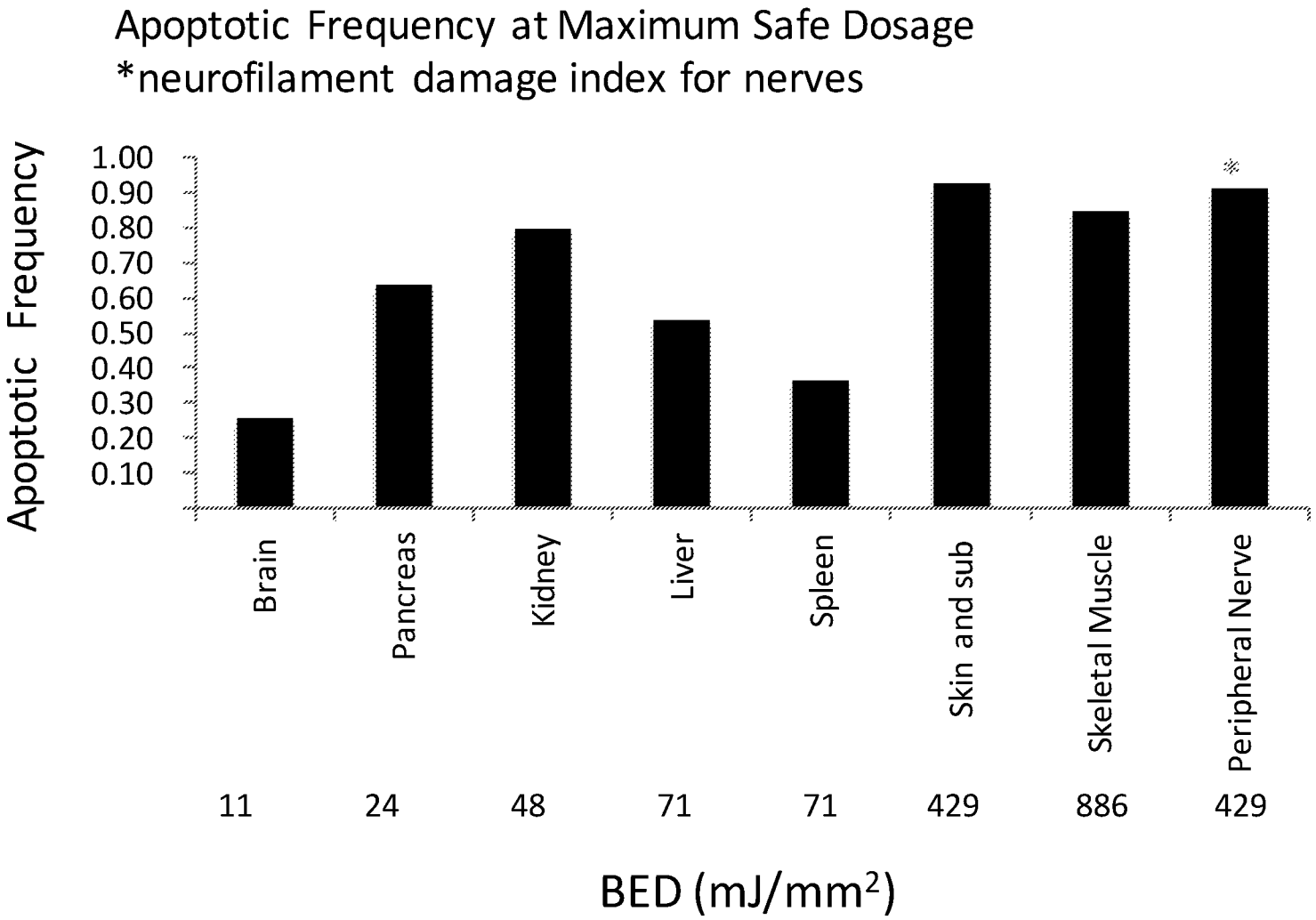
FIG. 4A and FIG. 4B.
Figure 4B:
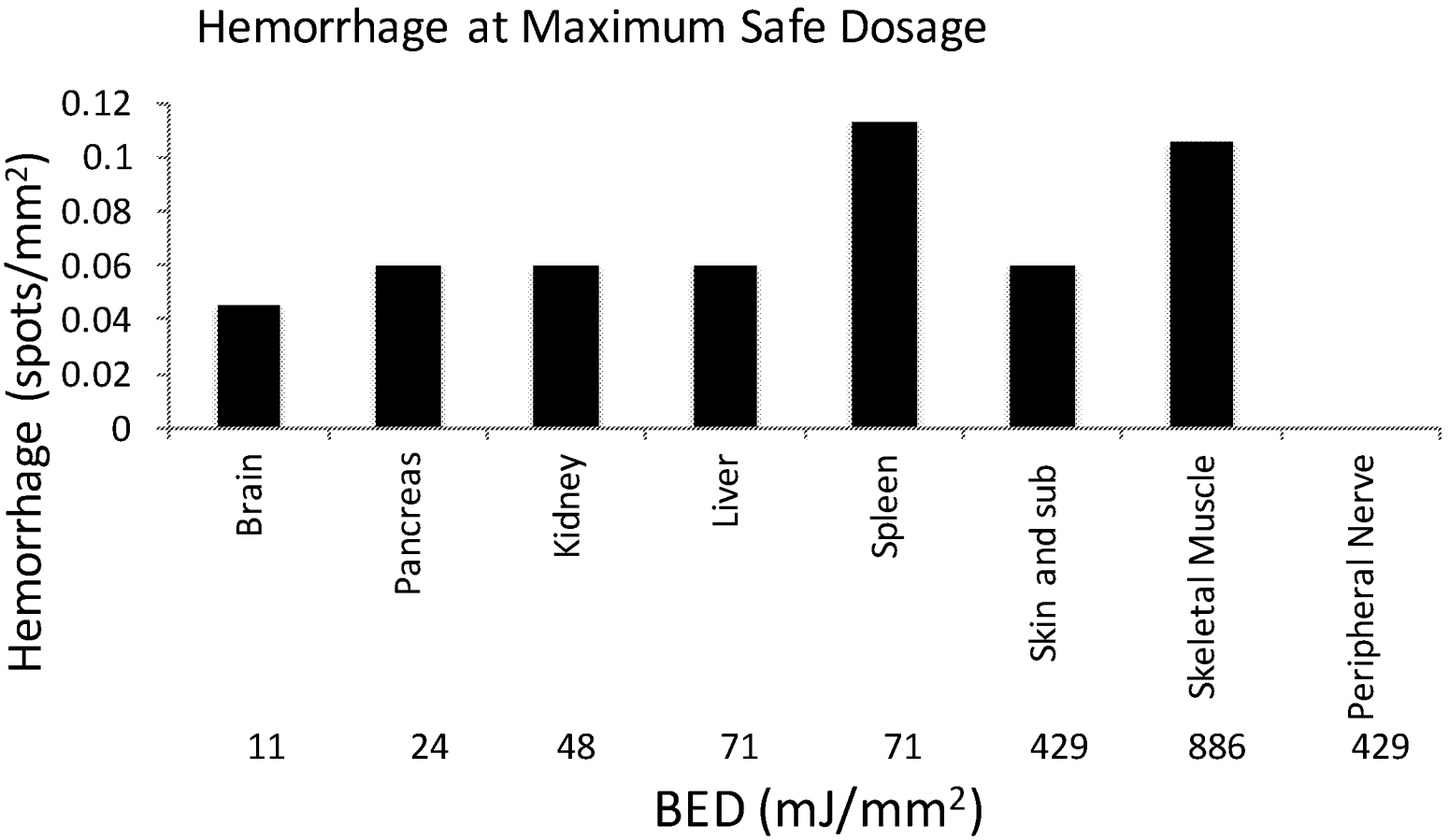

At lower dosages, no hemorrhage was observed. As energy increased, the incidence of hemorrhage increased in a dosage-dependent manner. Representative hemorrhage data are presented in FIG. 4.

Sections of tissue were also assessed for apoptosis. Apoptosis was detected by terminal deoxynucleotidyl transferase dUTP nick end labeling (TUNEL), a method for detecting DNA fragmentation. The tissue fixation, embedding, and sectioning were conducted as followed: frozen sections were fixed in 4% PFA in TBS for 20 min at room temperature and slides were washed 30 min in TBS. Sections were covered in Triton X-100 and washed in TBS. TUNEL-staining mix was then added and sections were covered with a coverslip, then incubated 60 min at 37° C. in the dark. Slides were then washed in TBS, liquid removed, and covered in PI (1 μg/ml). Coverslips were mounted using an aqueous-based Fluorescence Mounting Medium and then slides were stored in the dark.

The tissue sections were examined under microscopy at low power magnification (×100) and the total number of low power fields (LPF) needed to cover the entire slide section was measured first. For example, there were average 20 LPF on kidney sections and 21 LPF on brain sections. Then 5 LPFs were randomly selected and images were recorded. The total cell number in each LPF was counted with Image-Pro Plus 5.1 (Media Cybernetics, Silver Spring, Md., USA). This number was divided by 5 to obtain the average cell number in each LPF. The total cell number of the entire slide section was calculated by multiplying the average cell number with the total LPF Observed under fluorescence microscopy, the apoptotic cells appeared green in color. The total number of apoptotic cells on the entire slide section was also counted under microscopy with a hand-held counter. The apoptotic percentage was then calculated by dividing the total apoptotic cell number on each slide section by the total cell number on each slide section and converting to percentage.

Lower LESW dosages did not induce significant apoptosis over that of untreated controls. Higher LESW dosages induced greater apoptosis, in a dosage dependent manner. Representative results are presented in FIG. 2A-2H.

Example 4. Derivation of the Biologically Effective Cumulative Energy Density (BED)

In general, the cell culture and animal data were in good agreement. Clear patterns emerged among the treated cell types and tissues, with low LESW dosage having no positive or negative effects, intermediate dosages having positive effects and minimal harmful effects, and high dosages having harmful effects.

The large amount of data and similar results observed across cell types, tissue types, and indicators allowed for the derivation of the relationships between the parameters of an LESW dosage. EFD and number of pulses have a linear relationship to the biologic effect in the cells and tissues. However, the effect of frequency is non-linear. Equation 1, as set forth above, was derived, combining EFD, number of pulses, and frequency into a single measure of LESW energy delivery. The exponent value k for frequency was derived as the best fit of the data as 0.373.

Using the BED measure, it was determined that positive effects of LESW are observed at BED values of about 0.2 mJ/mm$^2$ (progenitor cell proliferation) to 1.5 (adaptive UPR). Below this cutoff, LESW appears to have no observable biological effect.

As for harmful LESW effects, these appeared at different thresholds for different tissues. Micro-hemorrhage in excess of 0.06 hemorrhage spots per mm$^2$ first occurred at BED's of 10.5 mJ/mm$^2$ in the brain, at BED's of 24 mJ/mm$^2$ in the pancreas, at BED's of 48 mJ/mm$^2$ in the kidney, at BED's of 71 mJ/mm$^2$ in the spleen and liver, at BED's of 429 mJ/mm$^2$ in the skin and subcutaneous tissue, and at BED's of 886 mJ/mm$^2$ in skeletal muscle. Unacceptable apoptotic frequency (at the upper thresholds described previously) first occurred in brain (11 mJ/mm$^2$) and pancreas (24 mJ/mm$^2$), next in kidney (48 mJ/mm$^2$), liver and spleen (71 mJ/mm$^2$) and last in skin, subcutaneous tissue (429 mJ/mm$^2$) and skeletal muscle (886 mJ/mm$^2$). Unacceptable neurofilament damage (at the upper threshold described previously) occurred at BED values of 429 mJ/mm$^2$.

At points between the harmful and ineffective dosages, the beneficial effect of LESW was confirmed in various organs, as in the following Examples.

Example 5. Effects of LESW on Brain Stem/Progenitor Cells

This experiment was designed to study the effect of LESW on neural stem/progenitor cells in the subventricular zone (SVZ) and hippocampus of adult rat brain, where brain stem/progenitor cells are known to exist. Ten rats at age 8 weeks were used in this project. The animals were divided into two groups. Each group was divided into sham control group (S, n=1), EdU injection control (C, n=2), and EdU injection/shock wave treatment group (SW, n=2). 5-ethynyl-2'-deoxyuridine (EdU) was injected twice: 24 hours before and 24 hours after the shock wave treatment. Shockwaves were delivered by the Demagold instrument. The LESW dosage was 200 pulses at an EFD of 0.01 mJ/mm$^2$, at a frequency of 3 Hz] (BED dosage value of 3.0 mJ/mm$^2$ employing a k value of 0.373) administered twice a week.

The short-term study rats were sacrificed at 1 week and the long-term study animals were sacrificed at 4 weeks after the shock wave treatment. The brain tissues were harvested for histology assay. Ten micron thick sections were assayed with doublecortin (DcX) (a marker for young brain cells), NeuN antibody (a marker for mature brain cells), and EdU (marker for cell proliferation) staining.

LESW at a BED of 3.0 mJ/mm$^2$ significantly increased the EdU positive cells in the brain tissue 1 week after EMSW, but EdU positive cells decreased to the level of control rats at 4 weeks. Most of the EdU positive cells were within the hippocampus and differentiated into mature neurons (Neu N+/DcX−/EdU+ positive cells) 4 weeks after LESW treatment. LESW treatment also significantly increased the EdU positive neurons within the SVZ and hippocampus, especially the SVZ. There were 4 times more EdU+ cells within the SVZ than in control brain samples. There was also a significant increase in cells expressing DcX, a marker of young neurons.

Example 6. LESW Treatment of the Pancreas

In this experiment, the effects of LESW on the pancreas and the insulin-producing islet cells was investigated in an STZ-induced type-I diabetic rat model. Forty-eight Sprague-Dawley rats were randomly divided into four groups, comprising a control group, and three groups receiving intraperitoneal STZ injections: 10 mg/kg STZ (every week for 6 weeks); 20 mg/kg (every week for 6 weeks); 60 mg/kg (once). Each group was equally divided into sham and LESW treatment sub-groups. One week after STZ injection, an LESW dosage of 300 pulses at an EFD of 0.01 mJ/mm$^2$ at 3 Hz which comprises a BED dosage value of 4.5 mJ/mm$^2$, was administered to the targeted organs/tissues, twice per week for 6 weeks. Shockwaves were delivered by the Demagold instrument. Blood glucose was monitored weekly. At the end of study, the pancreas was excised for histologic studies of the islets with antibodies against insulin and glucagon.

LESW treatment did not change the level of fasting blood glucose or histology of the pancreas. Ten mg/kg of STZ weekly for 6 weeks did not change fasting blood glucose either, but it altered the structure of the rat islet cells and reduced the number of beta cells. STZ at 20 mg/kg weekly gradually increased the blood glucose to an average of 250 mg/dl with more damage to the islet cells and a reduction in beta cells. STZ at 60 mg/kg once induced increased blood glucose level to 400 mg/dl within days and almost total destruction of the islets and beta cells. In the 20 mg/kg group, LESW maintained normal level of fasting blood glucose for a longer period of time with less alteration of islets and better preservation of beta cells.

For the in vitro experiments, 100 islet cells were used for each experiment. The islets were cultured in regular DMEM (10% FBS, 5 mM glucose), or in DMEM (10% FBS, 5 mM glucose) with 5 mg/ml Tunicamycin™, or with DMEM with high glucose (HG) (10% FBS, 25 mM glucose). Shockwaves were delivered by the Dermagold instrument once, at a dosage of 200 pulses at an EFD of 0.01 mj/mm$^2$ at 3 Hz (having a BED value of 3.0 mJ/mm$^2$, employing a k value of 0.373) Cells were cultured for 16 hrs followed by TM or HG treatment for 4 hrs. PCR assays were performed to quantify XBP1 splicing and BiP expression.

LESW pretreatment with LEWS at a BED dosage of 3.0 mJ/mm$^2$ reduced XBP1 splicing and increased BIP mRNA levels. It was also demonstrated that in contrast to control islets, LESW pretreatment did not further increase XBP1 slicing while the BiP mRNA levels were increased in response to pro-apoptotic treatments—Tunicamycin™ or hyperglycemia (25 mM glucose). Thus, LESW mitigated the harmful effect of streptozotosin (STZ), a powerful toxin that selectively damages the beta cells of the pancreas, demonstrating the potential of LESW treatment, for example at a BED of 3.0 mJ/mm$^2$, as a potential therapy for progressive diabetes mellitus characterized by continuing loss of beta cells of pancreas.

Example 7. LESW Treatment of the Kidney

This experiment was designed to examine the effect of LESW on diabetic nephropathy (DN) in an animal model of insulin-dependent diabetes. 36 rats were given intraperitoneal EdU (50 mg/kg) to label progenitor cells at birth and were randomly divided into three groups: control (C), diabetic (DM) and diabetic treated with LESW (DMSW). At age 8 weeks, rats in groups DM and DMSW were induced to develop insulin-dependent diabetes by STZ injection (60 mg/kg). Eight weeks after the rats developed diabetes, extracorporeal LESW was applied to the kidneys at a dosage of 300 pulses at an EFD of 0.01 mJ/mm$^2$ at 3 Hz, comprising a dosage having a BED value of 3.0 mJ/mm$^2$ (employing a k value of 0.373) twice a week for 3 weeks. Shockwaves were delivered by the Dermagold instrument. Urine was collected every week to monitor hematuria and proteinuria. After one-week wash out, blood was collected for creatinine and BUN assays. The kidneys were harvested for histological studies including EdU staining, PAS, RECA and TUNEL staining.

Rats treated with LESW showed significantly less serum BUN levels than observed in the DM control group and improved serum creatinine relative to DM controls. LESW did not induce significant hematuria or proteinuria. LESW treatment, for example at a BED dosage of 3.0 mJ/mm$^2$ represents a potential novel therapy for diabetic nephropathy in insulin dependent diabetes.

Example 8. Treatment of the Urethral Sphincter with LESW

Currently, there are limited medical methods to reverse stress urinary incontinence which is a result of sphincteric muscle dysfunction/weakness. To investigate the effect of LESW in a rat vaginal balloon dilation (VBD) model of stress urinary incontinence (SUI), the following experiments were conducted. Thirty-two Sprague-Dawley female rats (12 weeks age) were randomly divided into four groups: normal control, normal+LESW, VBD control, and VBD+LESW. LESW was applied to the urethral sphincter area at a dosage of 300 pulses at an EFD of 0.01 mJ/mm$^2$ at 3 Hz, comprising a dosage having a BED value of 4.5 mJ/mm$^2$ (employing a k value of 0.373) every two days by the Demagold instrument. Animals were sacrificed at 4 days or 1 week post VBD. The entire urethra was harvested and used for RT-PCR and histological assays for the genes related to striated muscle regeneration, including myostatin (MSTN), myosin heavy chain fast (MHCf), and myosin heavy chain slow (MHCs).

In the meantime, another 24 Sprague-Dawley female rats were used for a long-term experiment and were randomly divided into three groups, including normal control, VBD control, and VBD+LESW. LESW was applied at the same dosage as the previous group (0.01 mJ/mm$^2$, 300 pulses, 1 Hz) twice per week for three weeks. One week after LESW, leak-point pressure (LPP) testing was performed. The entire urethra was harvested MSTN, MHCf, and MHCs were assayed.

In the short-term experiment, rats receiving LESW at a BED value of 4.5 mJ/mm$^2$ showed significantly decreased MSTN in both normal and VBD treated rats at 4 days and 1 week. In the long-term experiment, rats receiving LESW at a BED of 4.5 mJ/mm$^2$ showed significantly improved LPP's as compared to VBD controls (44.8±3.2 cmH20 versus 27.0±2.9 cmH20, $p<0.01$). LESW significantly improved the urethral striated muscle regeneration.

The results demonstrate that LESW represents a potential novel therapy for urethral striated muscle regeneration in men or women with stress urinary incontinence.

All patents, patent applications, and publications cited in this specification are herein incorporated by reference in their entirety to the same extent as if each independent patent, patent application, or publication was specifically and individually indicated to be incorporated by reference. The disclosed embodiments are presented for purposes of illustration and not limitation. While the invention has been described with reference to the described embodiments thereof, it will be appreciated by those of skill in the art that modifications can be made to the structure and elements of the invention without departing from the spirit and scope of the invention as a whole.

What is claimed is:

1. A method of treating or preventing a disease condition in a region of the brain of an animal by administering a dosage of low energy acoustic shock waves, wherein the dosage comprises a number of shockwaves delivered; an energy flux density of the shockwaves received by the treated region of the brain; and a frequency of shockwave delivery;

energy received by the treated region of the brain from the dosage of low energy acoustic shock waves is sufficiently high to induce the proliferation rate of cells within the treated tissue;

energy received by the treated region of the brain from the dosage of low energy acoustic shock waves is sufficiently low that it does not induce an observed apoptotic frequency in the treated tissue of greater than 0.26% and/or an observed frequency of hemorrhage greater than 0.035 hemorrhage spots per mm$^2$ tissue section;

the dosage is a biologically effective dosage calculated as a product of: the number of shockwaves delivered; the energy flux density of the shockwaves received by the organ; and $Hz^k$, wherein Hz is the frequency of shockwave delivery in Hertz and k is approximately 0.373; and the biologically effective dosage is between 0.2 and 11.0 mJ/mm$^2$.

2. The method of claim 1, wherein the disease condition is selected from a group consisting of a degenerative condition of the brain, brain trauma, ischemic damage, cerebral vascular accident, Alzheimer's disease, Parkinson's disease, amyotrophic lateral sclerosis (ALS), and dementia.

3. A method of treating or preventing a disease condition in a region of a kidney of an animal by administering a dosage of low energy acoustic shock waves, wherein the dosage comprises a number of shockwaves delivered; an energy flux density of the shockwaves received by the treated region of the kidney; and a frequency of shockwave delivery;

energy received by the treated region of the kidney from the dosage of low energy acoustic shock waves is sufficiently high to induce an increase in the proliferation rate of cells within the treated region of the kidney;

energy received by the treated region of the kidney from the dosage of low energy acoustic shock waves is sufficiently low that it does not induce an observed apoptotic frequency in the treated region of the kidney of greater than 1.0% and/or an observed frequency of hemorrhage greater than 0.06 hemorrhage spots per mm$^2$ tissue section;

the dosage is a biologically effective dosage calculated as the product of: the number of shockwaves delivered; the energy flux density of the shockwaves received by the treated region of the kidney; and $Hz^k$, wherein Hz is the frequency of shockwave delivery in Hertz and k is approximately 0.373; and the biologically effective dosage is between 0.2 and 48.0 mJ/mm$^2$.

4. The method of claim 3, wherein the disease condition is selected from a group consisting of: acute renal failure; chronic kidney diseases; renal insufficiency; proteinuria; diabetic and lupus nephropathy; glomerulus calcification; tubulo-interstitial lesions; and renal artery stenosis/ischemia.

5. A method of treating or preventing a disease condition in the pancreas of an animal by administering a dosage of low energy acoustic shock waves, wherein the dosage comprises a number of shockwaves delivered; an energy flux density of the shockwaves received by the pancreas; and a frequency of shockwave delivery;

energy received by the pancreas from the dosage of low energy acoustic shock waves is sufficiently high to induce an increase in the proliferation rate of cells within the pancreas;

energy received by the pancreas from the dosage of low energy acoustic shock waves is sufficiently low that it does not induce an observed apoptotic frequency in the pancreas of greater than 1.0% and/or an observed frequency of hemorrhage greater than 0.06 hemorrhage spots per $mm^2$ tissue section;

the dosage is a biologically effective dosage calculated as the product of: the number of shockwaves delivered; the energy flux density of the shockwaves received by the pancreas; and $Hz^k$, wherein Hz is the frequency of shockwave delivery in Hertz and k is approximately 0.373; and the biologically effective dosage is between 0.2 and 24.0 $mJ/mm^2$.

6. The method of claim 5, wherein the disease condition is prediabetes, Type I or Type II diabetes.

7. A method of treating or preventing a disease condition in a region of the liver of an animal by administering a dosage of low energy acoustic shock waves, wherein the dosage comprises a number of shockwaves delivered; an energy flux density of the shockwaves received by the treated region of the liver; and a frequency of shockwave delivery;

energy received by the treated region of the liver from the dosage of low energy acoustic shock waves is sufficiently high to induce an increase in the proliferation rate of cells within the treated region of the liver;

the clinically significant harm is an observed apoptotic frequency in the treated region of the liver of greater than 1.0% and/or an observed frequency of hemorrhage greater than 0.06 hemorrhage spots per $mm^2$ tissue section;

the dosage is a biologically effective dosage calculated as the product of: the number of shockwaves delivered; the energy flux density of the shockwaves received by the treated region of the liver; and $Hz^k$, wherein Hz is the frequency of shockwave delivery in Hertz and k is approximately 0.373; and the biologically effective dosage is between 0.2 and 71.0 $mJ/mm^2$.

8. The method of claim 7, wherein the disease condition of the liver is selected from a group consisting of a degenerative disease of the liver; liver failure; fatty liver; cirrhosis; fibrosis; and hepatitis.

9. A method of treating or preventing a disease condition in the spleen of an animal by administering a dosage of low energy acoustic shock waves, wherein the dosage comprises a number of shockwaves delivered; an energy flux density of the shockwaves received by the spleen; and a frequency of shockwave delivery;

energy received by the spleen from the dosage of low energy acoustic shock waves is sufficiently high to induce an increase in the proliferation rate of cells within the spleen;

energy received by the spleen from the dosage of low energy acoustic shock waves is sufficiently low that it does not induce an observed apoptotic frequency in the spleen of greater than 1.0% and/or an observed frequency of hemorrhage greater than 0.12 hemorrhage spots per $mm^2$ tissue section;

the dosage is a biologically effective dosage calculated as the product of: the number of shockwaves delivered; the energy flux density of the shockwaves received by the spleen; and $Hz^k$, wherein Hz is the frequency of shockwave delivery in Hertz and k is approximately 0.373; and the biologically effective dosage is between 0.2 and 71.0 $mJ/mm^2$.

10. The method of claim 9, wherein the disease condition is selected from a group consisting of a degenerative disease of the spleen; enlarged spleen; autoimmune diseases; and functional asplenia.

11. A method of treating or preventing a disease condition in a peripheral nerve of an animal by administering a dosage of low energy acoustic shock waves, wherein the dosage comprises a number of shockwaves delivered; an energy flux density of the shockwaves received by the treated peripheral nerve; and a frequency of shockwave delivery;

energy received by the treated peripheral nerve from the dosage of low energy acoustic shock waves is sufficiently high to induce an increase in the proliferation rate of cells within the treated peripheral nerve;

the clinically significant harm is an observed neurofilament damage index in the treated peripheral nerve of greater than 1.0%;

the dosage is a biologically effective dosage calculated as the product of: the number of shockwaves delivered; the energy flux density of the shockwaves received by the treated peripheral nerve; and $Hz^k$, wherein Hz is the frequency of shockwave delivery in Hertz and k is approximately 0.373; and the biologically effective dosage is between 0.2 and 429.0 $mJ/mm^2$.

12. The method of claim 11, wherein the disease condition of the nerve is selected from a group consisting of: peripheral neuropathy; neuritis; ALS; nerve injury/damage; diabetic neuropathy; nerve degeneration; demyelinating diseases; and multiple sclerosis.

13. A method of treating or preventing a disease condition in a skeletal muscle or for strengthening a skeletal muscle of an animal by administering a dosage of low energy acoustic shock waves, wherein the dosage comprises a number of shockwaves delivered; an energy flux density of the shockwaves received by the treated skeletal muscle; and a frequency of shockwave delivery;

energy received by the treated skeletal muscle from the dosage of low energy acoustic shock waves is sufficiently high to induce an increase in the proliferation rate of cells within the treated skeletal muscle;

energy received by the treated skeletal muscle from the dosage of low energy acoustic shock waves is sufficiently low that it does not induce an observed apoptotic frequency in the treated skeletal muscle of greater than 1.0% and/or an observed frequency of hemorrhage greater than 0.12 hemorrhage spots per $mm^2$ tissue section;

the dosage is a biologically effective dosage calculated as the product of: the number of shockwaves delivered; the energy flux density of the shockwaves received by the treated skeletal muscle; and $Hz^k$, wherein Hz is the frequency of shockwave delivery in Hertz and k is approximately 0.373; and the biologically effective dosage is between 0.2 and 886.0 $mJ/mm^2$.

14. The method of claim 13, wherein the disease condition of the skeletal muscle is muscle atrophy, muscle injury, muscle weakness, sarcopenia, urinary incontinence or stool incontinence.

* * * * *